US011918062B2

(12) United States Patent
Corrigan et al.

(10) Patent No.: US 11,918,062 B2
(45) Date of Patent: Mar. 5, 2024

(54) CLOTHING ARTICLE HAVING A SUPPORT MEMBER

(71) Applicant: LUNAR APPAREL LTD., West Vancouver (CA)

(72) Inventors: Charles Ryan Corrigan, Waterloo (CA); Bastien Jourde, Montreal (CA); Philippe Lefebvre, Montreal (CA); Audrey Labelle, Montreal (CA)

(73) Assignee: LUNAR APPAREL LTD., West Vancouver (CA)

( * ) Notice: Subject to any disclaimer, the term of this patent is extended or adjusted under 35 U.S.C. 154(b) by 0 days.

(21) Appl. No.: 18/158,281

(22) Filed: Jan. 23, 2023

(65) Prior Publication Data

US 2023/0157385 A1 May 25, 2023

Related U.S. Application Data

(63) Continuation of application No. PCT/CA2021/050992, filed on Jul. 19, 2021.

(60) Provisional application No. 63/054,625, filed on Jul. 21, 2020.

(51) Int. Cl.

| | |
|---|---|
| ***A41D 13/05*** | (2006.01) |
| ***A41D 13/06*** | (2006.01) |
| ***A41D 13/08*** | (2006.01) |

(52) U.S. Cl.

CPC ..... *A41D 13/0531* (2013.01); *A41D 13/065* (2013.01); *A41D 13/08* (2013.01)

(58) Field of Classification Search

CPC ... A41D 1/06; A41D 1/08; A41D 1/09; A41D 13/0543; A41D 17/02; A61F 5/0109

See application file for complete search history.

(56) References Cited

U.S. PATENT DOCUMENTS

| | | | | |
|---|---|---|---|---|
| 5,299,323 | A | 4/1994 | Schaefer | |
| 7,241,252 | B1 * | 7/2007 | Gagliardi | A63B 21/4025 2/400 |
| 2007/0094775 | A1 | 5/2007 | Chun | |
| 2012/0117714 | A1 * | 5/2012 | Peck | A41D 31/185 2/228 |
| 2014/0101815 | A1 * | 4/2014 | Caulfield | A41F 17/00 2/400 |

(Continued)

FOREIGN PATENT DOCUMENTS

| | | | |
|---|---|---|---|
| EP | 2815662 | A1 | 12/2014 |

OTHER PUBLICATIONS

International Search Report and Written Opinion for PCT/CA2021/050992 dated Nov. 2, 2021.

*Primary Examiner* — Katherine M Moran

(74) *Attorney, Agent, or Firm* — Smart & Biggar LP

(57) ABSTRACT

A clothing article having a support member is provided. The clothing article includes an outer shell, a portion of the outer shell being dimensioned to fit loosely on a body of a wearer. A support structure has a support member supporting the body of the wearer when positioned thereon, and fits snugly on the body of the wearer, At least one tether portion extends between the support member and at least one connection region that is secured to the outer shell. At least a part of the at least one tether portion is dimensioned to enable the outer shell to move substantially freely relative to the support member when the clothing article is worn by the wearer.

18 Claims, 22 Drawing Sheets

(56) References Cited

U.S. PATENT DOCUMENTS

| | | | | |
|---|---|---|---|---|
| 2021/0235781 | A1* | 8/2021 | Carlson | A41D 1/08 |
| 2023/0015684 | A1* | 1/2023 | Stevens | A41C 3/0014 |

* cited by examiner

CLOTHING ARTICLE HAVING A SUPPORT MEMBER

CROSS-REFERENCE TO RELATED APPLICATIONS

This application is a continuation of PCT International Patent Application No. PCT/CA2021/050992 filed Jul. 18, 2021, which claims the benefit of U.S. Provisional Application No. 63/054,625, filed Jul. 21, 2020, the contents of which are incorporated herein by reference in their entirety.

FIELD

The specification relates generally to apparel, and, in particular, to a clothing article having a support member.

BACKGROUND OF THE DISCLOSURE

Traditional clothing is conventionally configured to provide a layer that is both stylistic and/or functional. For example, blue jeans were popularized in the late 1800s due to their ruggedness and appearance. More recently, sports-oriented clothing has seen the popularization of tights that fit snugly over a user's entire leg, part-leg (in the case of shorts), etc. In addition, there has been a number of clothing garments constructed of two materials, wherein an outer portion of the garment is made from a first material that loosely fits over the body of a wearer, and an inner portion of the garment is made from a second material that more snugly fits over the body of the wearer. Examples of such garments include swimming trunks and workout tops with integrated bras. Such garments, however, typically do not provide localized support along a portion of the inner garment. In addition, as the inner portion is configured to snugly fit to the body of the wearer, the outer portion, where it is stitched together with the inner portion is restricted from draping loosely.

SUMMARY OF THE DISCLOSURE

In one aspect, there is provided a clothing article having a support member, comprising: an outer shell, a portion of the outer shell being dimensioned to fit loosely on a body of a wearer; and a support structure having a support member supporting the body of the wearer when positioned thereon, the support member fitting snugly on the body of the wearer, and at least one tether portion extending between the support member and at least one connection region that is secured to the outer shell, at least a part of the at least one tether portion being dimensioned to enable the outer shell to move substantially freely relative to the support member.

The outer shell can have at least one opening to enable the wearer to adjust a position or the compression provided by the support member.

The opening can be reopenably closeable.

The support member can include at least one stiffening member to resist flexion of the support member.

The at least one connection region can be connected to the outer shell at at least one seam of the outer shell.

The support member can have a tension adjustment structure for adjusting tension of the support member on the body of the wearer.

The tension adjustment structure can include a at least two hook-and-loop elements enabling adjustment of a position of a first of the at least two hook-and-loop elements relative to a position of a second of the at least two hook-and-loop elements.

The clothing article can be a top, and the support member can support the posture of the wearer.

The support structure can be a lumbar support structure supporting a lumbar region of a wearer when the clothing article is worn.

The lumbar support structure can include at least one stiffening member to resist flexion of the lumbar support structure adjacent to the lumbar region of the wearer when positioned thereon.

The clothing article can be pants, and the at least one connection region of the lumbar support structure can be stitched to the outer shell at a position spaced from a waistline of the pants.

The at least one tether portion can include a gap adjacent to a front opening in the outer shell.

The clothing article can be pants, and the support member can be a knee support member supporting a knee of the wearer when the pants are worn by the wearer.

A leg of the outer shell within which the knee support member is positioned can have at least one opening facilitating adjustment of a position or tension of the knee support member when the pants are worn.

The at least one tether portion can include a first tether portion extending between an upper end of the knee support member and the leg of the outer shell, and a second tether portion extending between a lower end of the knee support member and the leg of the outer shell.

At least one of a first of the at least one connection region at which the first tether portion can be stitched to the leg and a second of the at least one connection region at which the second tether portion can be stitched to the leg is stitched at a seam of the leg of the outer shell.

The at least one tether portion can be provided by a sleeve, wherein a first of the at least one connection region is at a first end of the sleeve, wherein a second of the at least one connection region is at a second end of the sleeve, and wherein the support member is slidably repositionable along a longitudinal length of the sleeve.

The at least one tether portion can include at least one strap.

In another aspect, there is provided a clothing article having a support member, comprising: an outer shell; and a support structure connected to the outer shell along at least one connection region and having at least one floating region extending from the at least one connection region, the floating region having a support member supporting the body of the wearer when positioned thereon, and at least one tether portion extending between the support member to the at least one connection region, at least a part of the at least one tether portion being dimensioned to enable the outer shell to move substantially freely relative to the support member.

The outer shell can be dimensioned to fit loosely on the body of a wearer.

The support member can be dimensioned to fit snugly on the body of a wearer.

The outer shell can have at least one opening to enable the wearer to adjust a position or the compression provided by the support member.

The opening can be reopenably closeable.

The support member can include at least one stiffening member to resist flexion of the support member.

The at least one connection region can be connected to the outer shell at at least one seam of the outer shell.

The support member can have a tension adjustment structure for adjusting tension of the support member on the body of the wearer.

The tension adjustment structure can include a at least two hook-and-loop elements enabling adjustment of a position of a first of the at least two hook-and-loop elements relative to a position of a second of the at least two hook-and-loop elements.

The clothing article can be a top, and the support member can support the posture of the wearer.

The support structure can be a lumbar support structure supporting a lumbar region of a wearer when the clothing article is worn.

The lumbar support structure can include at least one stiffening member to resist flexion of the lumbar support structure adjacent to the lumbar region of the wearer when positioned thereon.

The clothing article can be pants, and the at least one connection region of the lumbar support structure can be stitched to the outer shell at a position spaced from a waistline of the pants.

The at least one tether portion can include a gap adjacent to a front opening in the outer shell.

The clothing article can be pants, and the support member can be a knee support member supporting a knee of the wearer when the pants are worn by the wearer.

A leg of the outer shell within which the knee support member is positioned can have at least one opening facilitating adjustment of a position or tension of the knee support member when the pants are worn.

The at least one tether portion can include a first tether portion extending between an upper end of the knee support member and the leg of the outer shell, and a second tether portion extending between a lower end of the knee support member and the leg of the outer shell.

At least one of a first of the at least one connection region at which the first tether portion is stitched to the leg and a second of the at least one connection region at which the second tether portion is stitched to the leg can be stitched at a seam of the leg of the outer shell.

The at least one tether portion can be provided by a sleeve, wherein a first of the at least one connection region is at a first end of the sleeve, wherein a second of the at least one connection region is at a second end of the sleeve, and wherein the support member is slidably repositionable along a longitudinal length of the sleeve.

The at least one tether portion can include at least one strap.

Other technical advantages may become readily apparent to one of ordinary skill in the art after review of the following figures and description.

BRIEF DESCRIPTIONS OF THE DRAWINGS

For a better understanding of the embodiment(s) described herein and to show more clearly how the embodiment(s) may be carried into effect, reference will now be made, by way of example only, to the accompanying drawings in which.

Figure 1A:
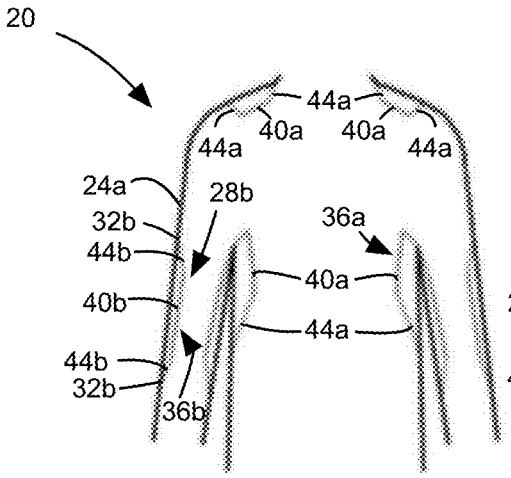
FIGS. 1A and 1B show a section view and a schematic view of a top in accordance with an embodiment.

Unless otherwise specifically noted, articles depicted in the drawings are not necessarily drawn to scale.

DETAILED DESCRIPTION

For simplicity and clarity of illustration, where considered appropriate, reference numerals may be repeated among the Figures to indicate corresponding or analogous elements. In addition, numerous specific details are set forth in order to provide a thorough understanding of the embodiment or embodiments described herein. However, it will be understood by those of ordinary skill in the art that the embodiments described herein may be practiced without these specific details. In other instances, well-known methods, procedures and components have not been described in detail so as not to obscure the embodiments described herein. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description. It will also be noted that the use of the term "a" or "an" will be understood to denote "at least one" in all instances unless explicitly stated otherwise or unless it would be understood to be obvious that it must mean "one".

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

Figure 1B:
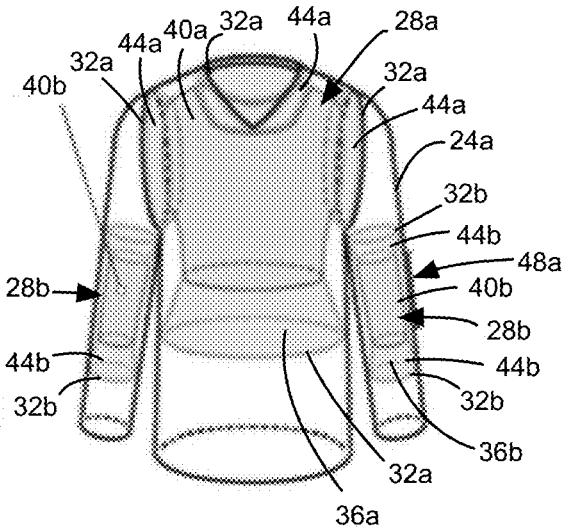

A top 20 in accordance with an embodiment is shown in FIGS. 1A and 1B. The top 20 includes an outer shell 24*a* that is dimensioned to fit loosely on the body of the wearer. That is, the outer shell 24*a* is sized so that its internal diameter(s) exceed the diameter(s) of the wearer by an amount so that the outer shell 24*a* does not snugly follow the body of the wearer. In other embodiments, the outer shell may be dimensioned to fit snugly or somewhat snugly on the body of the wearer. A support structure 28*a* is connected to the outer shell 24*a* along at least one connection region 32*a*. The support structure 28*a* has at least one floating region 36*a* extending from the at least one connection region 32*a*. The support structure 28*a* can be connected to the outer shell 24*a* via any suitable means. In one example, the support structure 28*a* can be woven together with the outer shell 24*a* along the at least one connection region 32*a*. In another example, the support structure 28*a* can be stitched to the outer shell 24*a* along the at least one connection region 32*a*. In a further example, the support structure 28*a* can be bonded to the outer shell along the at least one connection region 32*a* via any suitable means.

Extending along a portion of the at least one floating region 36*a* is a support member 40*a*. The support member 40*a* is configured to provide support to the upper torso of the wearer. The support can be compression (for example, to alleviate swelling or muscle fatigue), structural (for example, to support a joint or muscle alignment), etc. Tether portions 33*a* extend between the support member 40*a* and the connection regions 32*a*. At least a portion of the tether portions 44*a* are dimensioned to permit substantially free movement of the outer shell 24*a* relative to the support member 40. This allows the presence of the support member to be less pronounced, and allows more natural movement of the outer shell 24*a*. Further, movement of the outer shell 24*a* is less likely to shift the position or change the tension of the support member 40*a*. The tether portions 44*a* also function to facilitate the donning and doffing of the support member 40*a* with the top 20. The support members 40*a* and the tether portion 44*a* can be formed by any suitable manner. Suitable materials for providing the support members 40*a* can include, for example, stretch knit fabric with thermoplastic polyurethane (TPU) bonding, perforated stretch knit fabric with TPU bonding, stretch knit fabric with silicone details, stretch knit fabric with TPU bonding mixed with stretch mesh for more breathability, heavy stretch knit fabric (optionally with silicone details), seamless knitted sleeves, neoprene, TPU or polyurethane (PU), and stretch woven fabric.

The top 20 also includes an additional support structure 28*b* positioned within each sleeve of the outer shell 24*a*. The support structures 28*b* are connected to the outer shell 24*a* along a number of connection regions 32*b*. While two connection regions 32*b* are illustrated, it will be appreciated that any number of connection regions can be employed. Each support structure 28*b* has a floating region 36*b* extending between the two connection regions 32*b*. The support structure 28*b* can be connected to the outer shell 24*a* via any suitable means. In one example, the support structure 28*b* can be woven together with the outer shell 24*a* along the at least one connection region 32*b*. In another example, the support structure 28*b* can be stitched to the outer shell 24*a* along the at least one connection region 32*b*. In a further example, the support structure 28*b* can be bonded to the outer shell along the at least one connection region 32*b* via any suitable means.

Extending along a portion of each floating region 36*b* is a support member 40*b*. The support member 40*b* is configured to provide support (in the form of a compression force, in this example) to a corresponding elbow region of the wearer that is greater than a compression force applied to the body of the wearer by a tether portions 44*b* of the at least one floating region 36*b* extending between the support member 40*b* and the connection regions 32*b*. One or more parts of the tether portions 44*b* are dimensioned to enable substantially free movement of the outer shell 24*a* relative to the support member 40*b*. The support members 40*b* are formed in a similar manner to the support member 40*a*. In other embodiments, two or more support members can be provided on a support structure.

The support members 40*a*, 40*b* snugly fit atop of and remain positioned on the upper torso and elbow regions of the wearer, respectively. Some or all of the tether portions 44*a*, 44*b* loosely connect the support members 40*a*, 40*b* to the outer shell 24*a* at the connection regions 32*a*, 32*b*. Thus, the outer shell 24*a* can move substantially freely relative to some or all of the support members 40*a*, 40*b*. In some embodiments, the support structures 28*a*, 28*b* and/or the support members 40*a*, 40*b* can be made removable or otherwise adjustable via zippers, snaps, etc.

Reopenably closeable openings 48*a* are provided in the outer shell 24*a* to enable adjustment of the position, tension, etc. of the support members 40*b* on the elbow regions of the wearer. Each opening 48*a* can take the form of a zippered slit, an opening with overlapping panels that are unsecured or held together via one or more buttons or snaps, or hook-and-loop connectors, etc. The support member 40*b* can be provided with passive/active features to increase or decrease the compression provided across the support member 40*b* or along a portion thereof. Such active features can be accessed via the opening 48*a*. One or more openings can be provided at various locations along the outer shell 24*a* to facilitate adjustment of the various support members 40*a*, 40*b*. In other scenarios, the openings can be positioned anywhere along the outer shell to facilitate access to and adjustment of support members, such as for providing support for the lumbar, abdomen, neck, upper back, hips, knees, ankles, elbows, shoulders, etc.

Figure 1C:
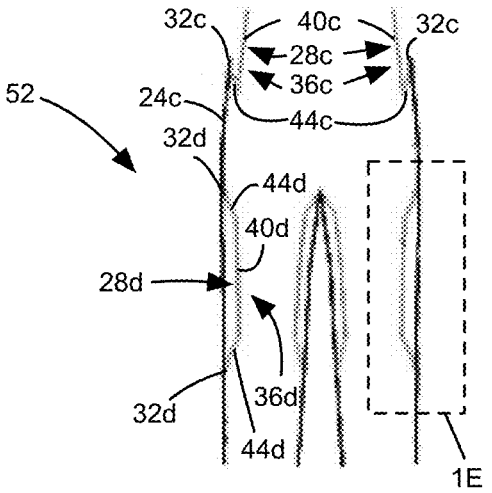
FIGS. 1C and 1D show a section view and a schematic view of pants in accordance with another embodiment.
Figure 1D:
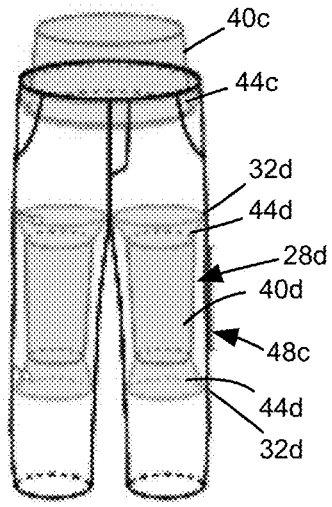
Figure 1E:
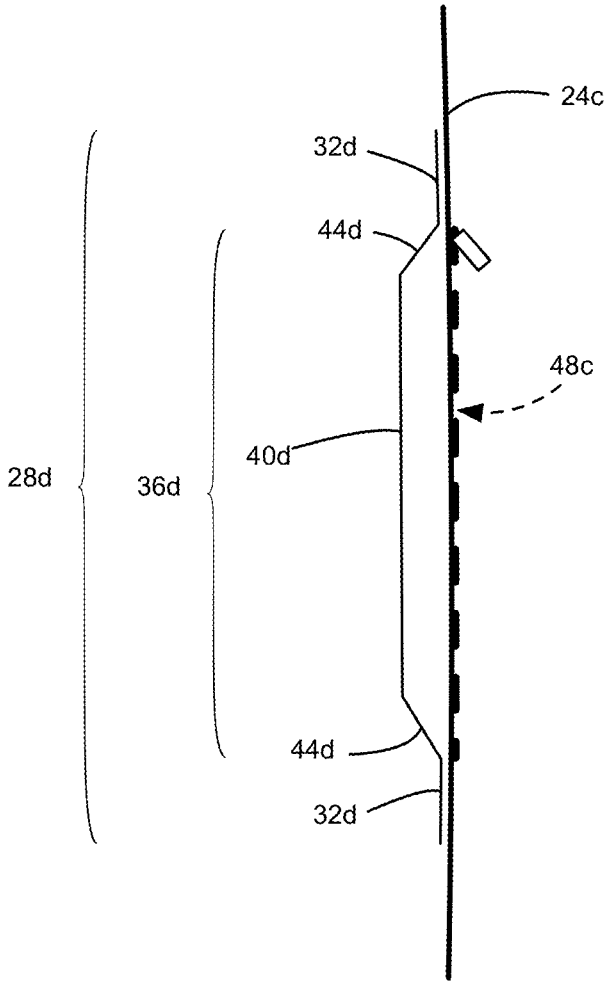
FIG. 1E shows region 1E of the pants in FIG. 1C in greater detail.

A pair of pants 52 in accordance with an embodiment is shown in FIGS. 1C to 1E. The pants 52 are constructed with the same general dimension and material considerations as described for the top 20 above. The pants 52 include an outer shell 24*c*, and a support structure 28*c* that is connected to the outer shell 24*c* along a connection region 32*c*. The support structure 28*c* has a floating region 36*c* extending from the connection region 32*c*. The support structure 28*c* can be connected to the outer shell 24*c* via any suitable means. In one example, the support structure 28*c* can be woven together with the outer shell 52 along the connection regions 32*c*. In another example, the support structure 28*c* can be stitched to the outer shell 24*c* along the connection regions 32*c*. In a further example, the support structure 28*c* can be bonded to the outer shell 24*c* along the connection regions 32*c*.

Extending along a portion of the at least one floating region 36*c* is a support member 40*c*. The support member 40*c* is configured to provide structural support to the lumbar region of the wearer.

One or more parts of the tether portions 44*c* are dimensioned to enable substantially free movement of the outer shell 24*c* relative to the support member 40*c*.

The pants 52 also include an additional support structure 28*d* positioned within each leg of the outer shell 24*c*. Each support structure 28*d* is connected to the outer shell 24*c* along two connection regions 32*d*, and has a floating region 36*d* extending between the two connection regions 32*d*. The support structures 28*d* can be connected to the outer shell 24*c* via any suitable means. In one example, the support structures 28*d* can be woven together with the outer shell 24*c* along the connection regions 32*d*. In another example, the support structures 28*d* can be stitched to the outer shell 24*c* along the connection regions 32*d*. In a further example, the support structures 28*d* can be bonded to the outer shell along the connection regions 32*d* via any suitable means.

Extending along a portion of each floating region 36*d* is a support member 40*d*. Each support member 40*d* is configured to apply a compression force and/or structural support to the knee of the wearer.

The support members 40*c*, 40*d* snugly fit atop of and remain positioned on the lumbar and knee regions of the wearer. One or more parts of the tether portions 44*c*, 44*d* are dimensioned to loosely connect the support members 40*c*, 40*d* to the outer shell 24*c* at the connection regions 32*c*, 32*d*. Thus, the outer shell 24*c* can move substantially freely relative to the support members 40*c*, 40*d*.

Reopenably closeable openings 48*c* are provided in the outer shell 24*c* to enable adjustment of the position, tension, etc. of the support members 40*d* on the knee regions of the wearer. Each opening 48*c* can take the form of a zippered slit, an opening with overlapping panels that are unsecured or held together via one or more buttons or snaps, or hook-and-loop connectors, etc. The support member 40*d* can be provided with passive/active features to increase or decrease the compression provided across the support member 40*d* or along a portion thereof. Such active features can be accessed via the openings 48*c*. In this manner, a wearer can quickly and easily adjust or alleviate the support provided by the support member 40*d*.

Figure 2A:
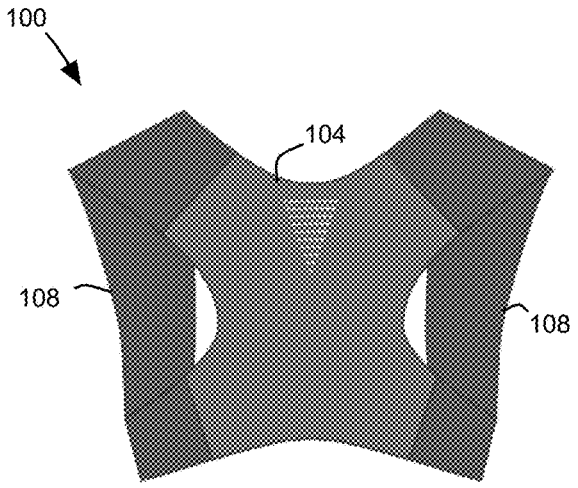
FIG. 2A is a rear view of a posture support member in accordance with a further embodiment.
Figure 2B:
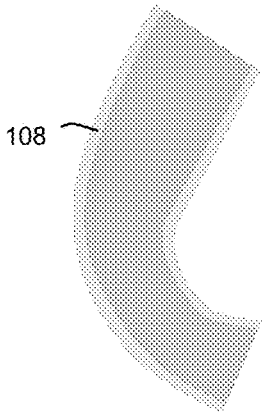
FIG. 2B shows a shoulder support component of the posture support member of FIG. 2A.
Figure 2C:
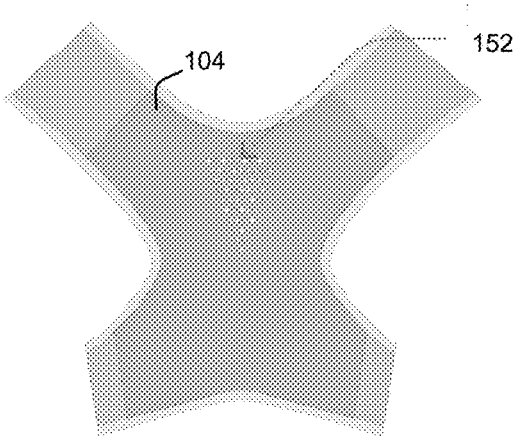
FIG. 2C shows an upper back support component of the posture support member of FIG. 2A.

FIGS. 2A to 2C show a support member 100 for a top in accordance with another embodiment. The support member 100 provides postural correction to support the upper back of a wearer. An upper back support component 104 is dimensioned to span the upper back of a wearer. A pair of shoulder support components 108 extend from the upper back support component 104 and wrap around the front of the shoulders of a wearer. When worn by a person, the support member 100 applies a force on the shoulders if they are positioned forward of a neutral position associated with good posture.

Figure 2D:
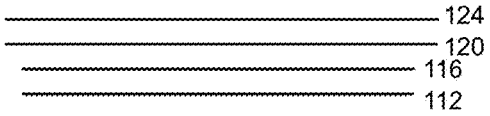
FIG. 2D shows the construction of the shoulder support component of FIG. 2B.

FIG. 2D shows the layers of construction of the shoulder support component 108. A compression fabric 112 such as lycra or any other suitable fabric for applying compression is positioned closest to the skin of a wearer and is overlaid with a stretch thermoplastic polyurethane (TPU) film 116. Next, another compression fabric 120 similar to the compression fabric 112 is positioned atop of the stretch TPU film 116 and a polyurethane (PU) overlay film 124 covers the underlying components 112 to 120. The layers 112 to 124 are heat bonded with a heat press machine. In other embodiments, the shoulder support component is made via silicone printing on textile, PU foam injection on textile, etc.

Figure 2E:
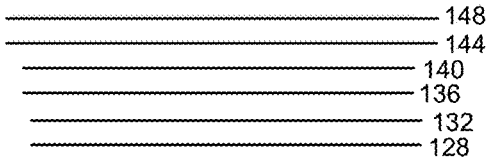
FIG. 2E shows the construction of the upper back support component of FIG. 2C.

FIG. 2E shows the layers of construction of the upper back support component 104. A compression fabric 128 such as lycra or any other suitable fabric for applying compression is positioned closest to the skin of a wearer and is overlaid with a stretch TPU film 132. Next, another compression fabric 136 similar to the compression fabric 128 is positioned atop of the stretch TPU film 132 and is covered by another layer of stretch TPU film 140. A third layer of compression fabric 144 similar to 128 and 136 is positioned atop of the second layer of stretch TPU film 140 and is covered by a PU overlay film 148. The layers 128 to 148 are heat bonded with a heat press machine. After heat bonding, perforations 152 are formed via laser cutting in the top center of the upper back support component 104 to provide breathability.

Figure 2F:
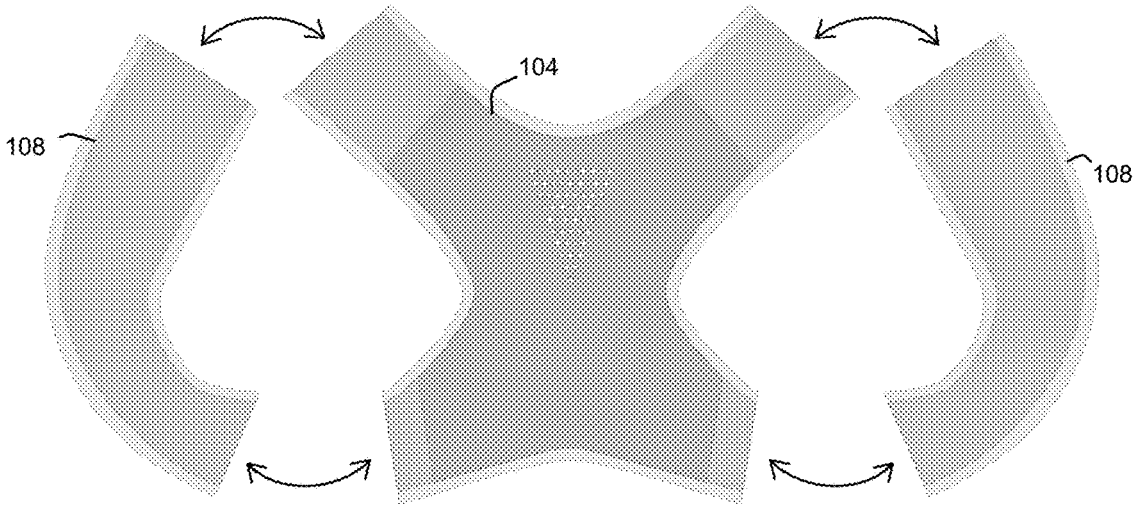
FIG. 2F shows the assembly of the posture support member from two of the shoulder support components of FIG. 2B and an upper back support component of FIG. 2C.

Once the shoulder support components 108 and the upper back support component 104 are formed, they are flatlock stitched together as shown in FIG. 2F.

Figure 3A:
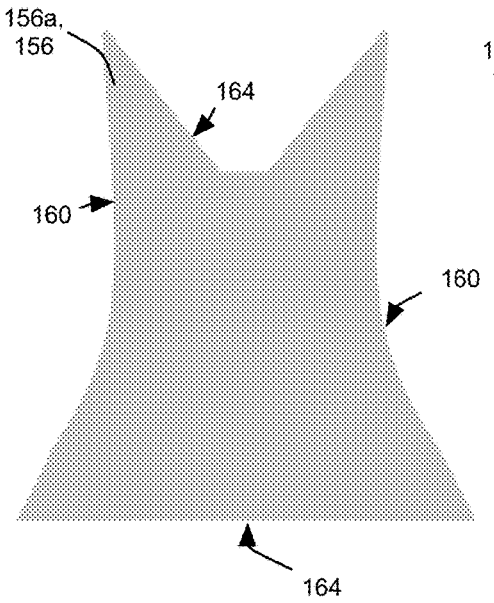
FIGS. 3A and 3B are front and rear views, respectively, of tether portions that are connected to the posture support member of FIG. 2A.
Figure 3B:
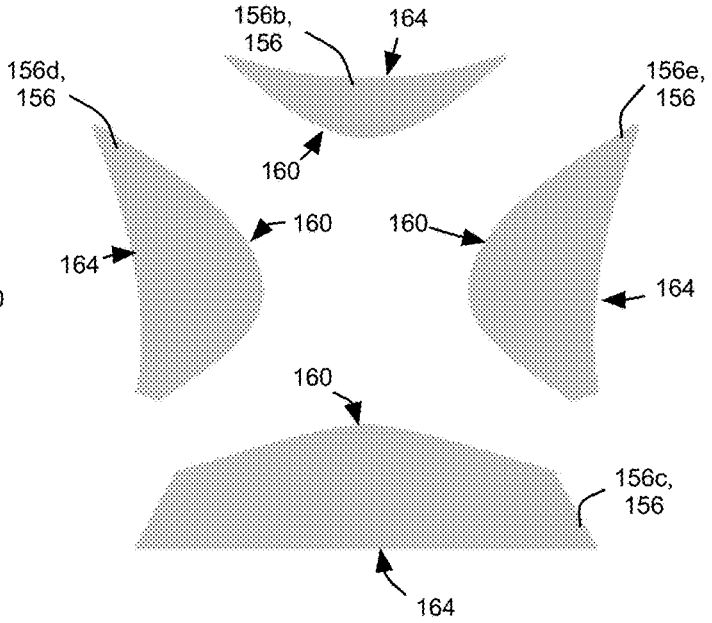

FIGS. 3A and 3B show tether portions 156*a*, 156*b*, 156*c*, 156*d*, and 156*e* (alternatively referred to as tether portions 156) that are to be connected to the support member of FIG. 2A. The tether portions 156 are preferably constructed of a lightweight material. For example, the tether portions 156 can be made of a stretch poly spandex mesh or a lightweight Lycra. Support member-interfacing regions 160 and connection regions 164 are positioned around edges of the tether portions 156.

Figure 4A:
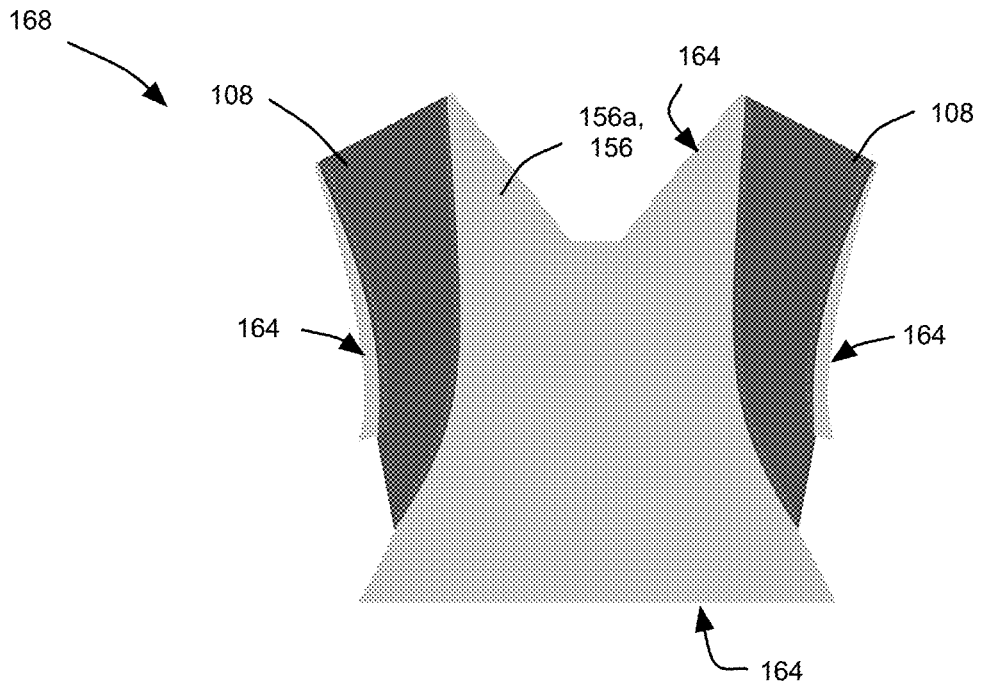
FIGS. 4A and 4B show front and back views, respectively, of a posture support structure assembled from the posture support member and the tether portions of FIGS. 2A to 2C.
Figure 4B:
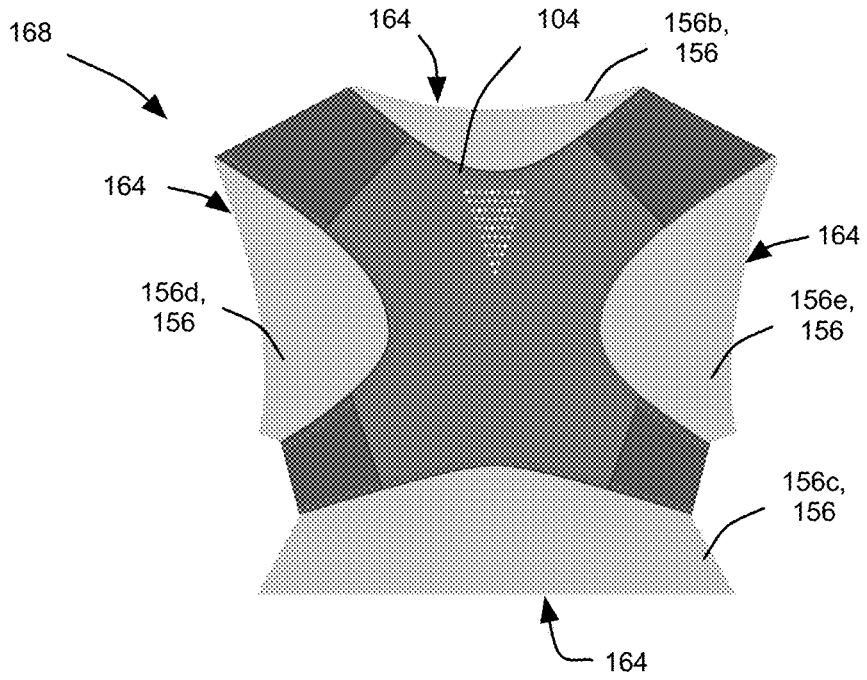

FIGS. 4A and 4B show a support structure 168 formed from the support member 100 and the tether portions 156. The support member 100 is connected to the support member-interfacing regions 160 of the tether portions 156 via any suitable means, such as stitching or heat bonding.

Figure 5:
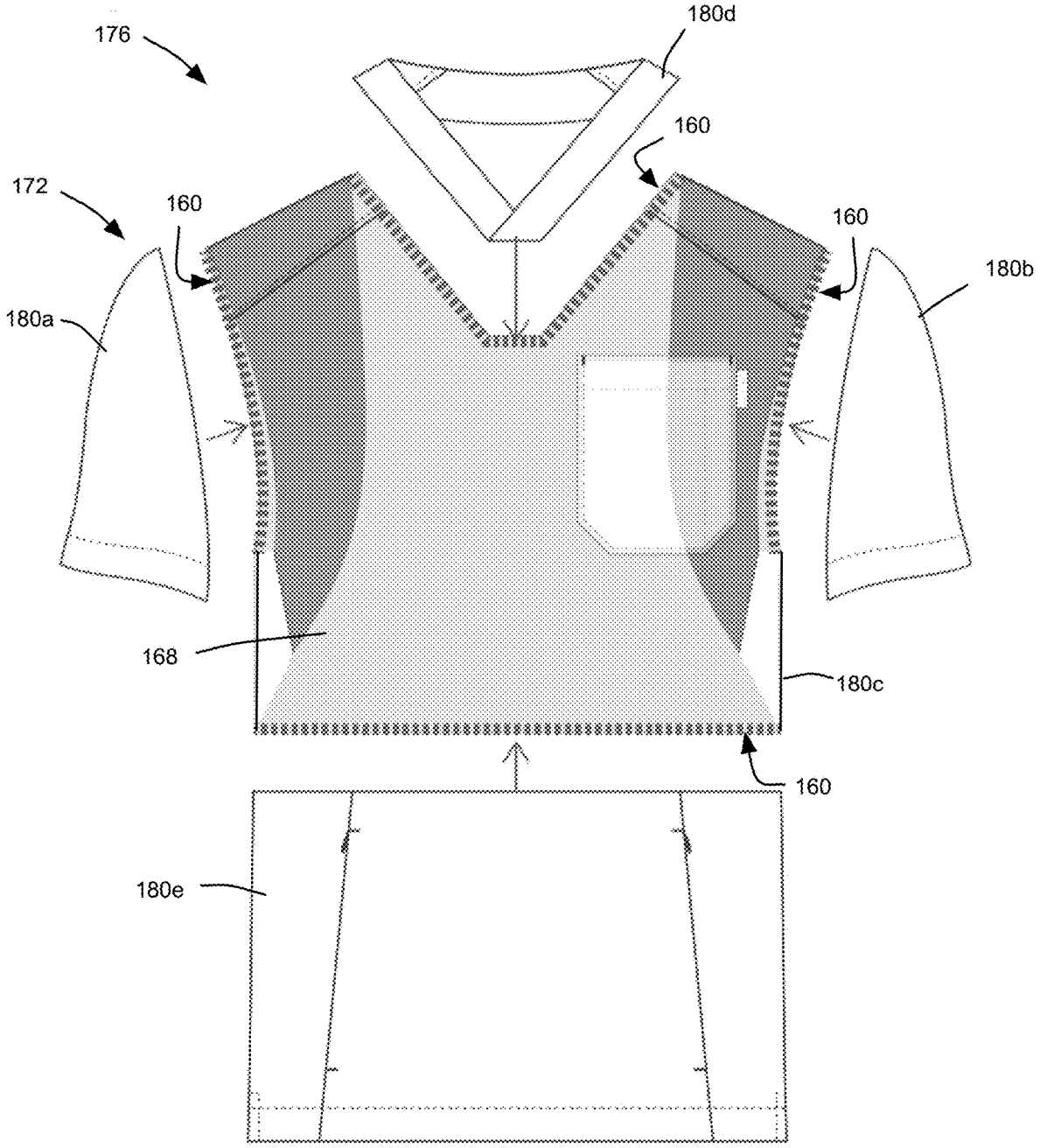
FIG. 5 shows the posture support structure of FIGS. 3B and 3C being connected to an outer shell to form a top.

Once the support structure 168 is assembled, it is connected to an outer shell 172 to form a top 176 as shown in FIG. 5. In particular, the connection regions 164 and various components, including sleeve components 180*a*, 180*b*, an upper torso component 180*c*, a collar component 180*d*, and a lower torso component 180*e*, are stitched together to form the outer shell 172. While, in this embodiment, the connection regions 164 are stitched to the outer shell 172 along seams thereof, it will be appreciated that the connection regions 164 can be secured to the outer shell 172 via stitching or any other suitable means at positions other than at seams of the outer shell 172 in other embodiments. Near the shoulders, areas of the support member 100 can directly extend from the connection regions 164 whereas the support member 100 can be coupled to the connection regions 164 via the tether portions 156 in other areas.

As will be appreciated, where there is spacing between the support member-interfacing region 160 and the connection region 164 of the tether portions 156, a greater degree of freedom between movement of the support member 100 and the outer shell 172 is afforded.

Figure 6A:
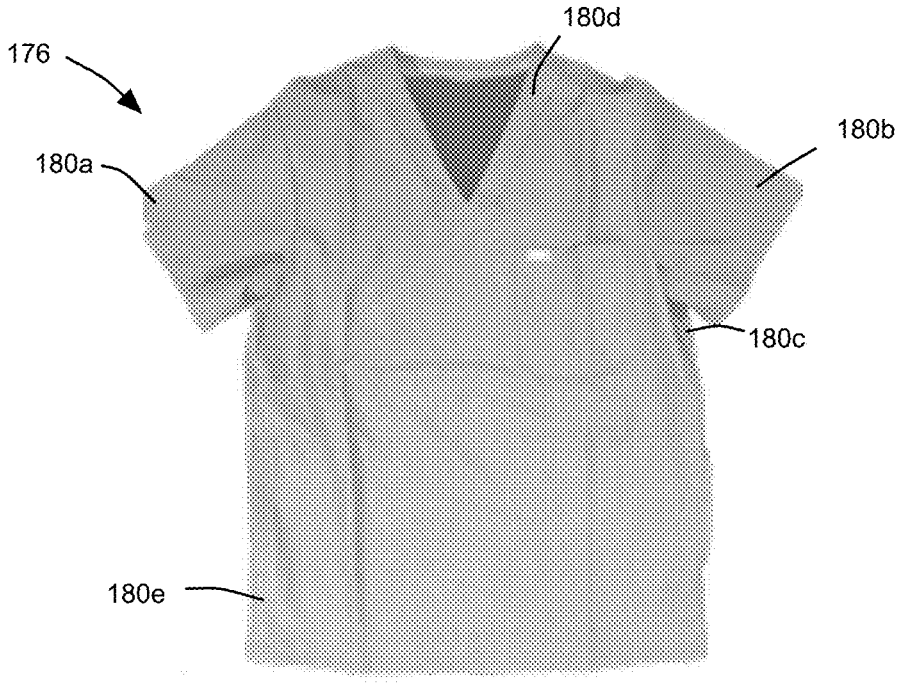
FIGS. 6A and 6B are front and rear views, respectively, of the assembled top of FIG. 5.
Figure 6B:
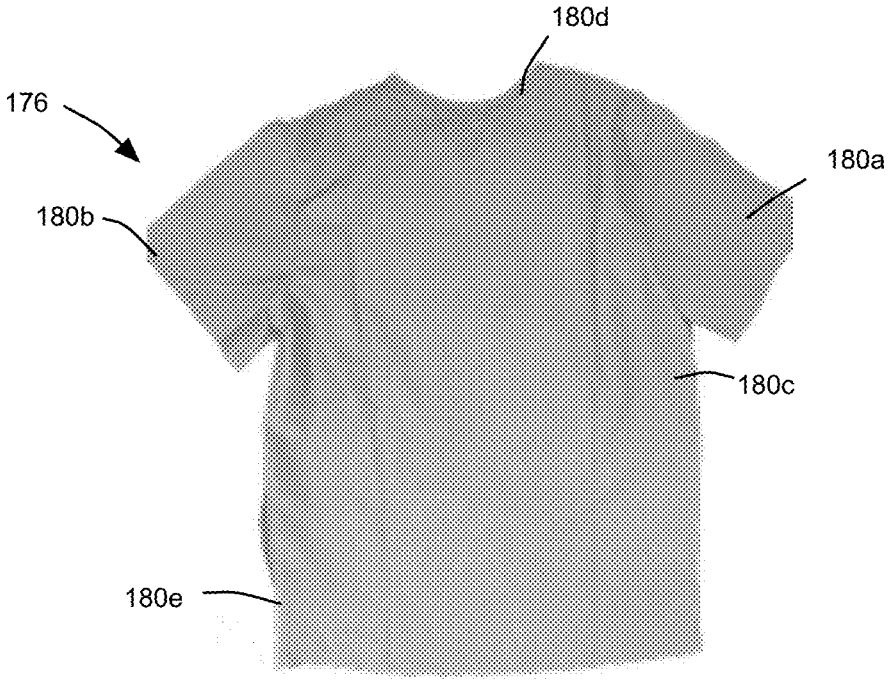
Figure 6C:
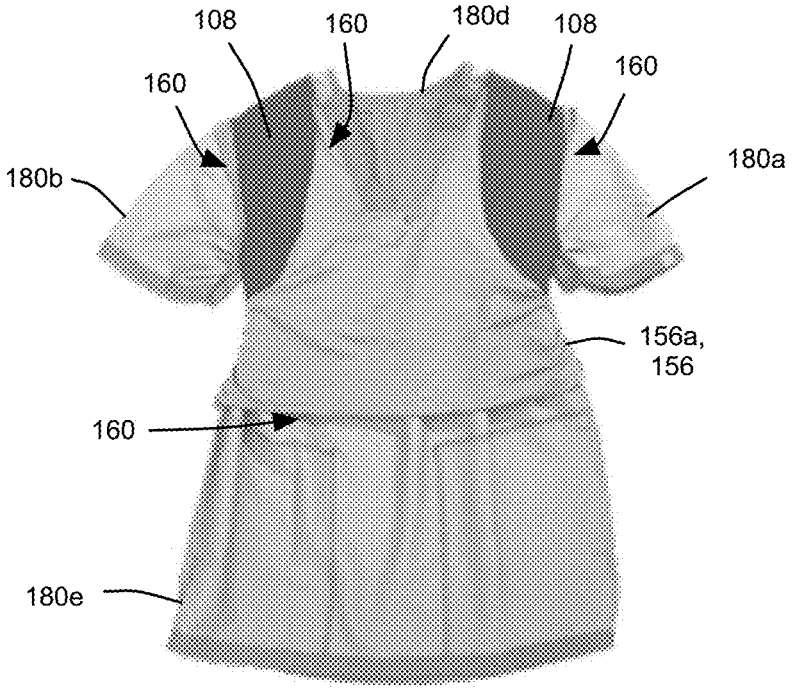
FIGS. 6C and 6D are front and rear views, respectively, of the assembled top of FIG. 5 after turning the top inside out.
Figure 6D:
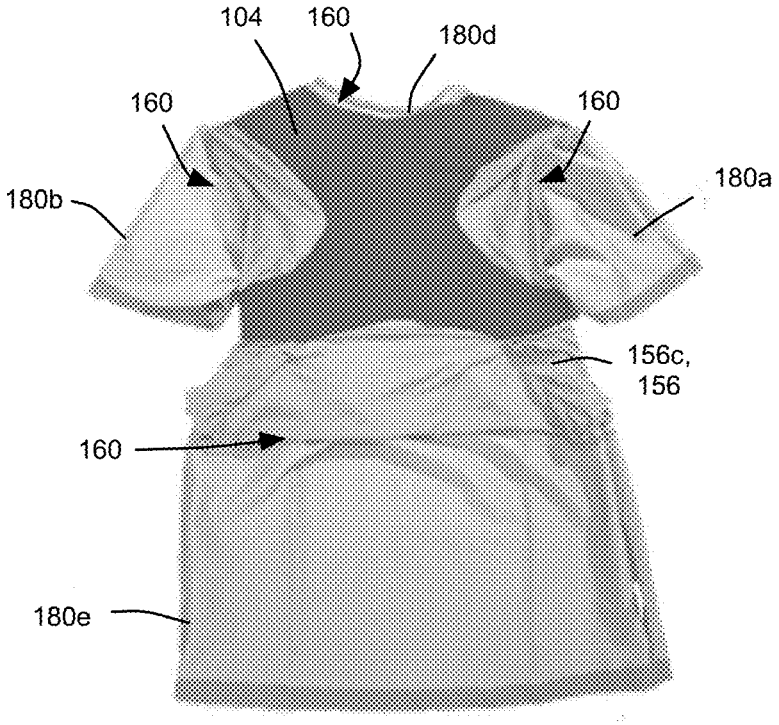

FIGS. 6A to 6D show the assembled top 176. In particular, FIGS. 6A and 6B show the outside view of the assembled top 176, and FIGS. 6C to 6D show the inner view (inside out/reversed), showing the compression support member 100 and the tether portions 156.

Figure 7A:
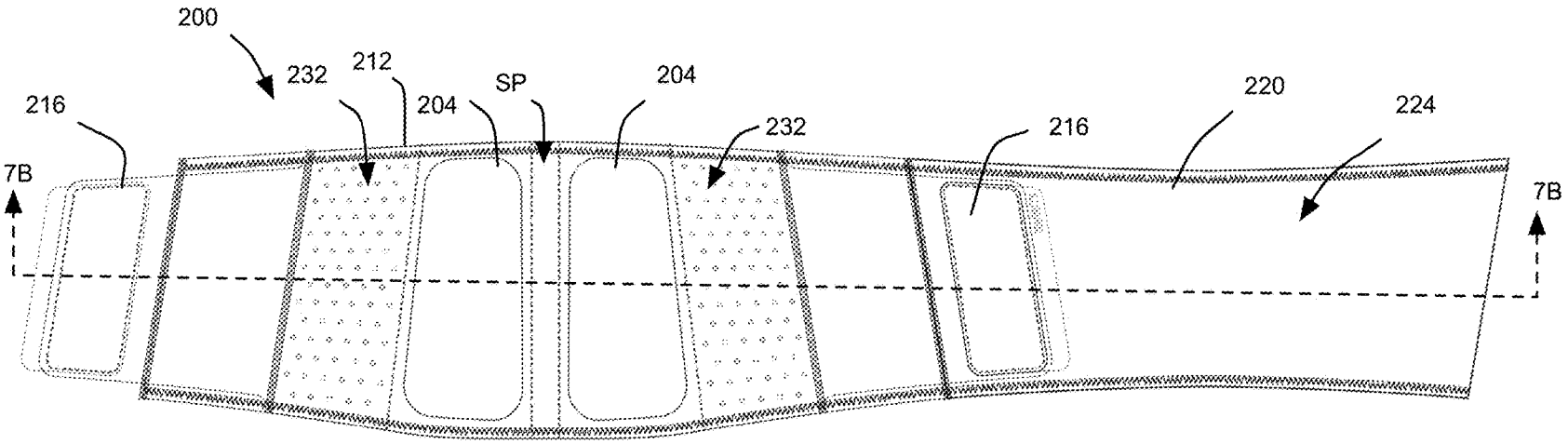
FIG. 7A shows a lumbar support member in accordance with another embodiment and similar to that shown in FIG. 1B.
Figure 7B:
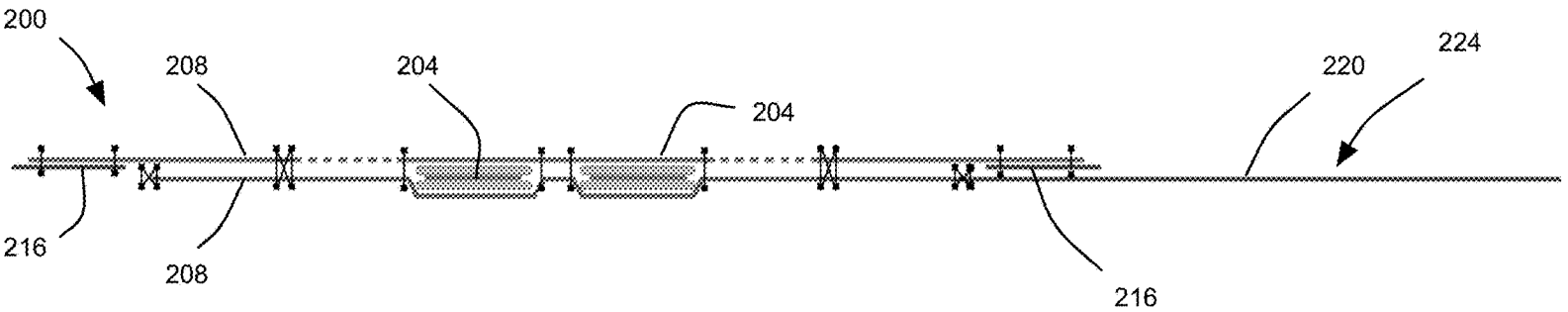
FIG. 7B shows a section view of the lumbar support member of FIG. 7A along 7B-7B.
Figure 7C:
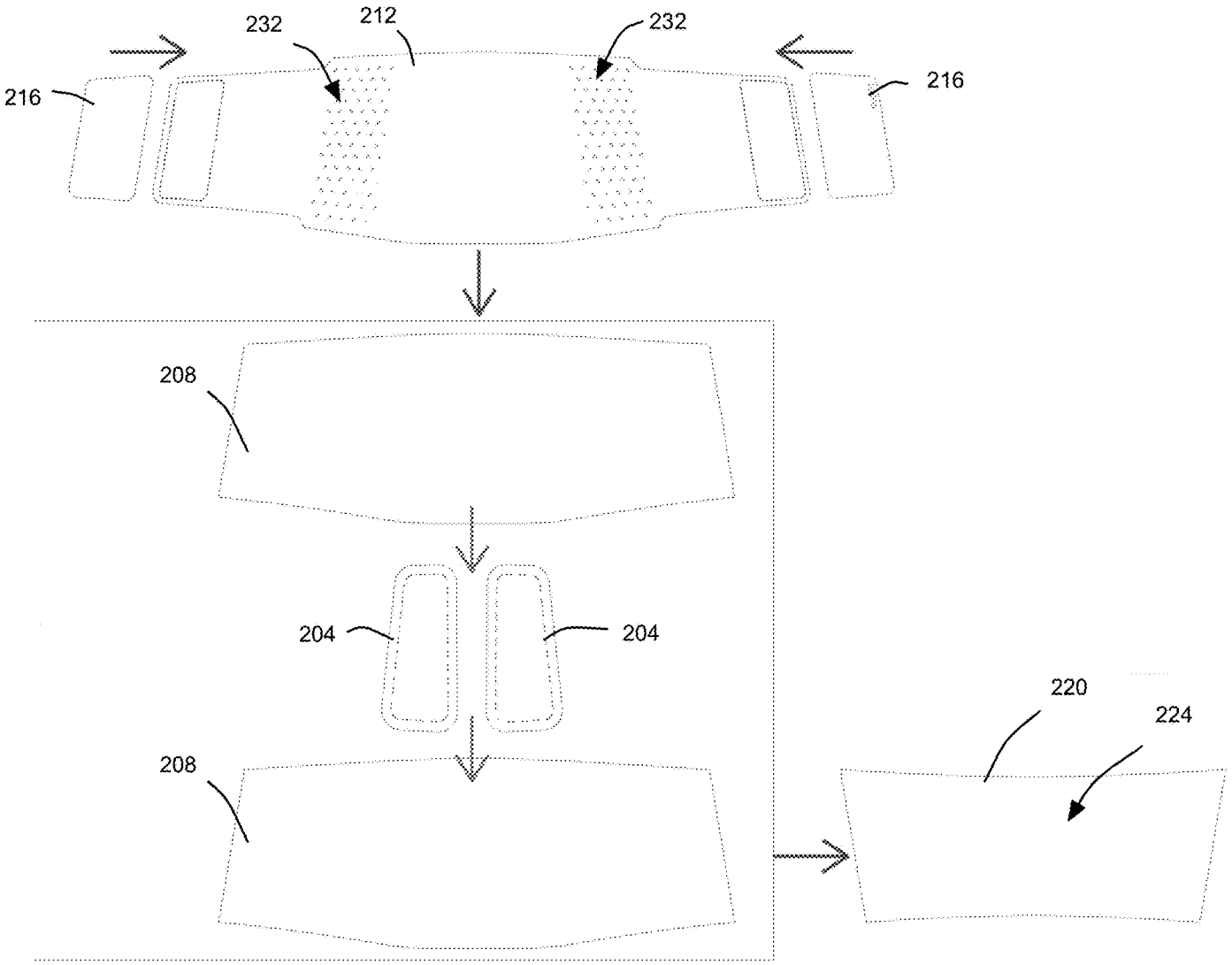
FIG. 7C shows the assembly of the lumbar support member of FIGS. 7A and 7B.

FIGS. 7A to 7C show a lumbar support member 200 in accordance with a further embodiment. The lumbar support member 200 is integrated into pants, as will be further described below. A user can adjust the tension provided by the lumbar support member 200 to their desired level.

The lumbar support member 200 includes a pair of stiffening bars 204 made of 2 millimeter acrylonitrile butadiene styrene (ABS) plastic plates sandwiched between layers of 3 millimeter comfort foam. The stiffening bars 204 can be any suitably stiff material or combination of materials and their shape and/or dimensions can be modified as desired. Spacing SP between the stiffening bars 204 accommodates the spine of the wearer. The stiffening bars 204 are sandwiched between two composite compression layers 208 that include a layer of compression fabric bonded with TPU film to form a support layer 212. The compression fabric can be any suitable material that be used to compress the lumbar region of a user. Perforations 218 are laser cut in the compression layer 208 that is positioned closest to a user's skin for breathability. A micro hook patch 216 with a PU backing is stitched to each end of the support layer 212. A stretch loop 220 is stitched to the stiffening layer and extends laterally. The stretch loop 220 has a TPU bonded compression fabric backing 224. The stiffening bars 204 resist flexure of the lumbar support member to support the lower back of a user. In other embodiments, the lumbar support can be provided via any other suitable means, such as injected PU foam over textile.

Figure 7D:
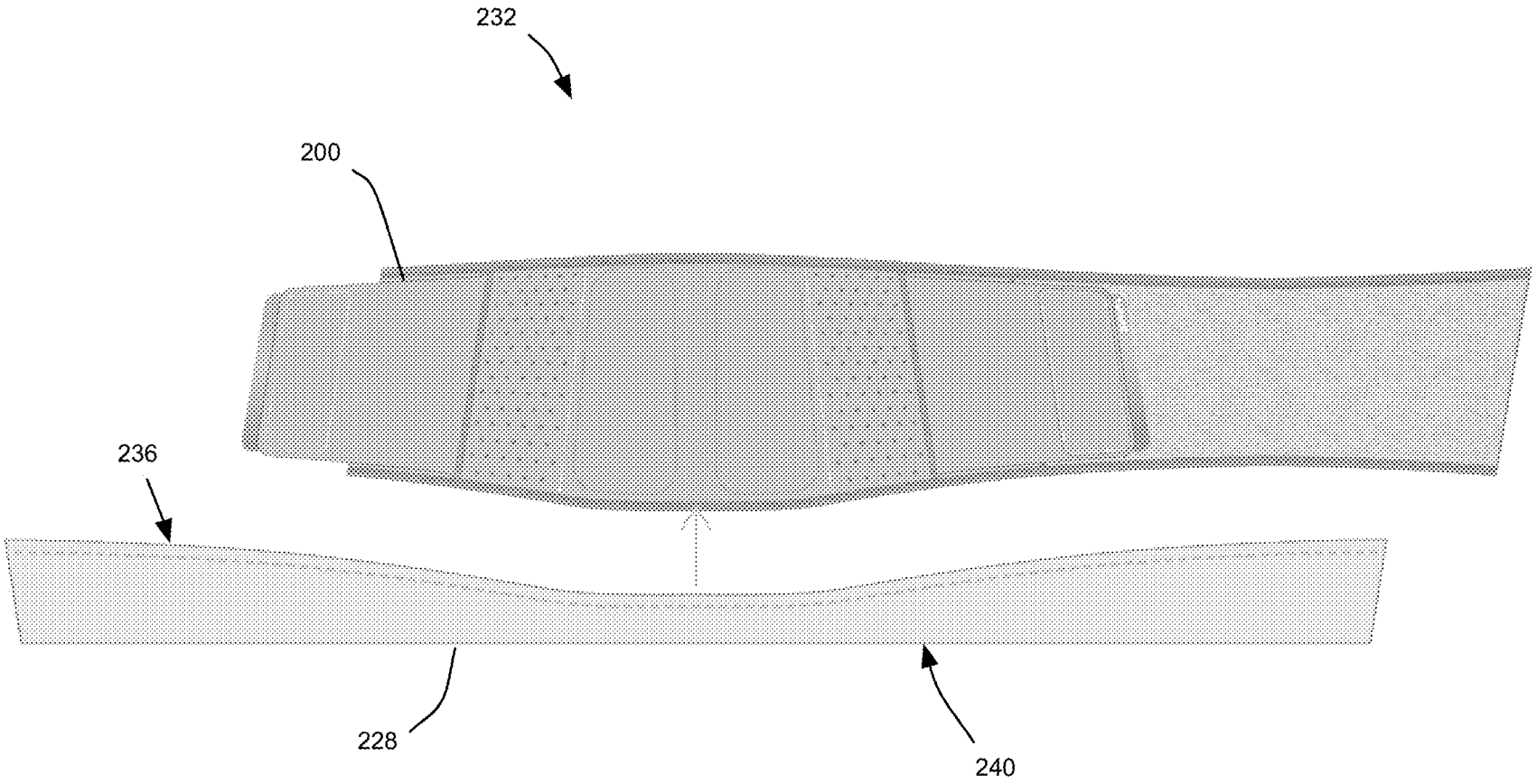
FIG. 7D shows the assembly of a lumbar support structure from the lumbar support member of FIGS. 7A and 7B, and a tether portion.
Figure 7E:
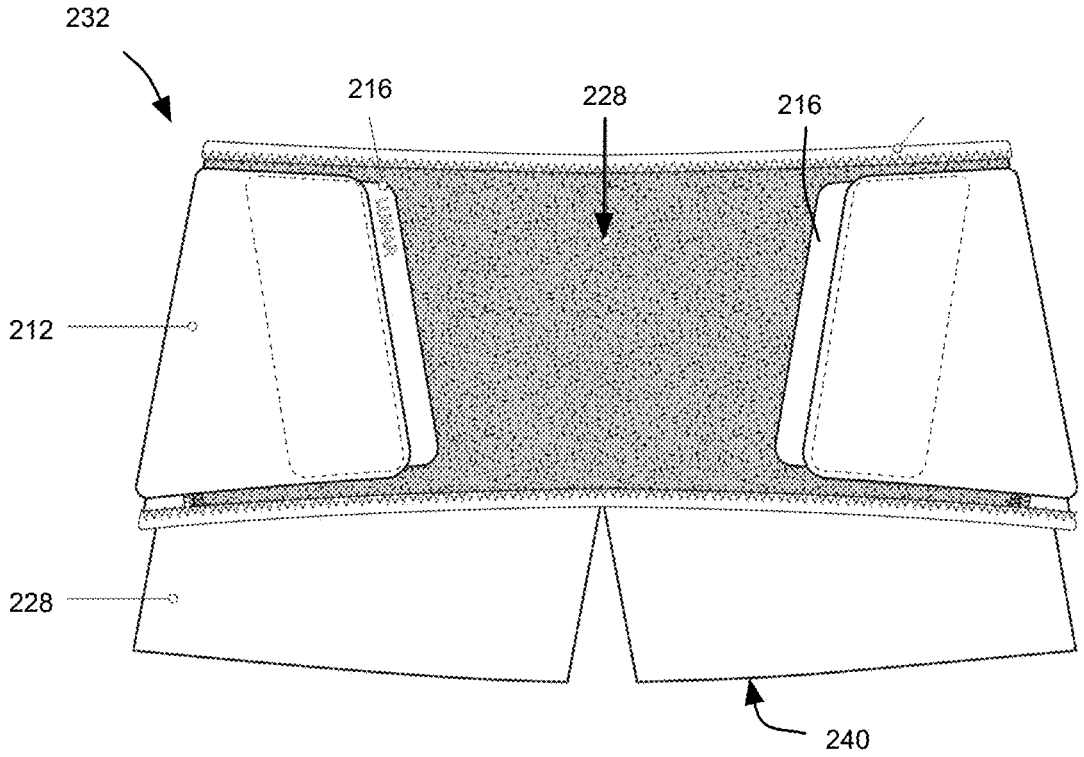
FIGS. 7E and 7F are front and rear views of the assembled lumbar support structure of FIG. 7D.
Figure 7F:
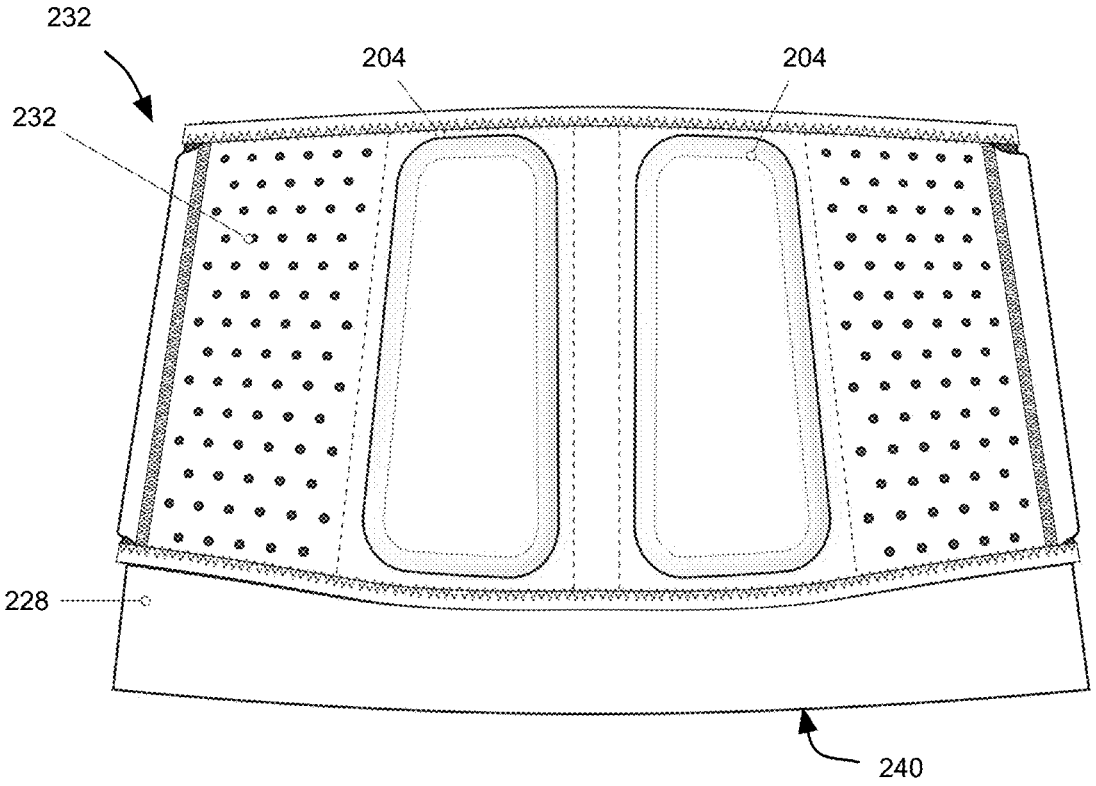

FIG. 7D shows the assembly of the lumbar support member 200 with a tether portion 228 to form a lumbar support structure 232 prior to integration into the pants. The tether portion 228 has a support member-interfacing region 236 to which the lumbar support member 200 is stitched, and a connection region 240. FIGS. 7E and 7F show the front and rear of the assembled lumbar support structure 232 after wrapping of the stretch loop 220 around so that the fabric backing 224 is engaged by the micro hook patch 216.

Figure 8B:
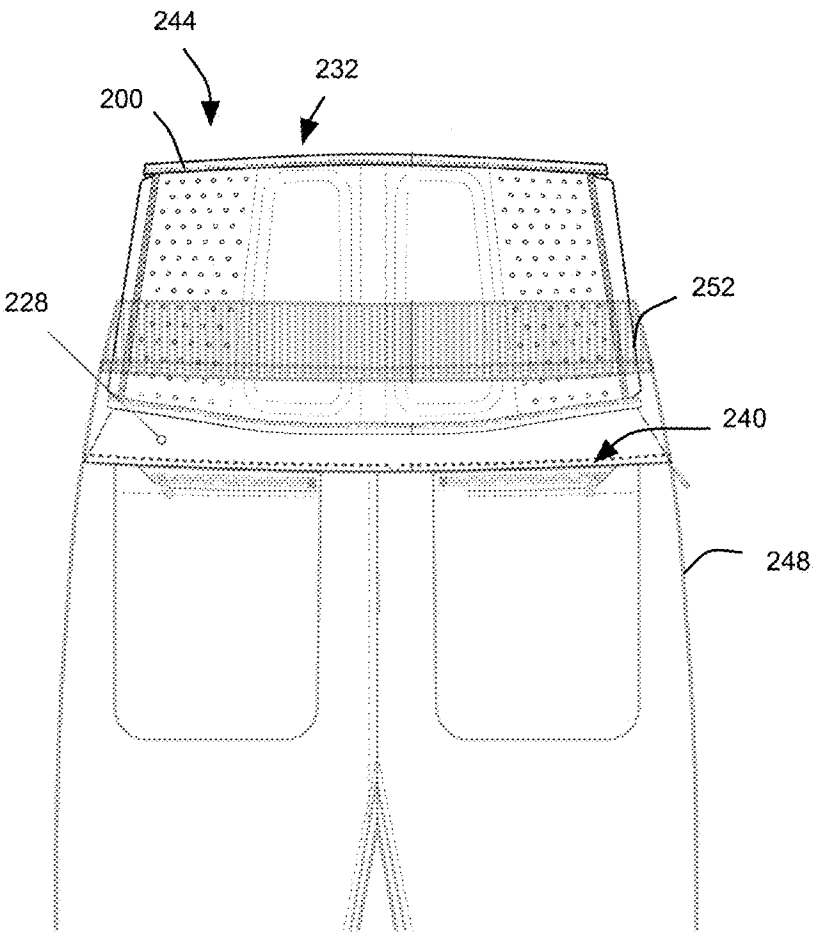
FIGS. 8A and 8B are front and rear views of pants assembled from the lumbar support member of FIGS. 7E and 7F.
Figure 8A:
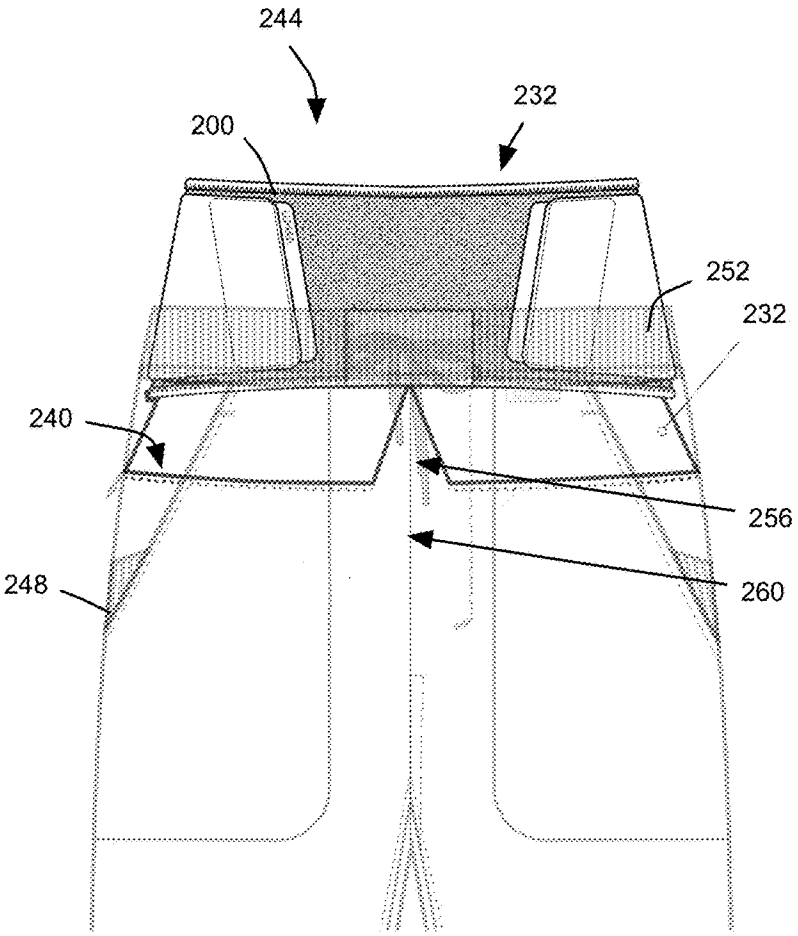

FIGS. 8A and 8B show a portion of pants 244 with the lumbar support structure 232 integrated therein. In particular, the tether portion 228 of the lumbar support structure 232 is secured to an outer shell 248 of the pants 244 via the connection region 240. The tether portion 228 is dimensioned so that the position (i.e., height) of the outer shell 248 can be adjusted relative to the lumbar support member 200. The connection region 240 is positioned below a waistline 252 so that there is room to tuck a top positioned over the lumbar support member 200 within the waistline 252 inside the outer shell 248. A V-shaped gap between the ends of the tether portion 228 positioned in the front of the pants 244 enables the tether portion 228 to not obstruct a front zippered or buttoned opening 260, such as may be present in some pants.

Figure 9A:
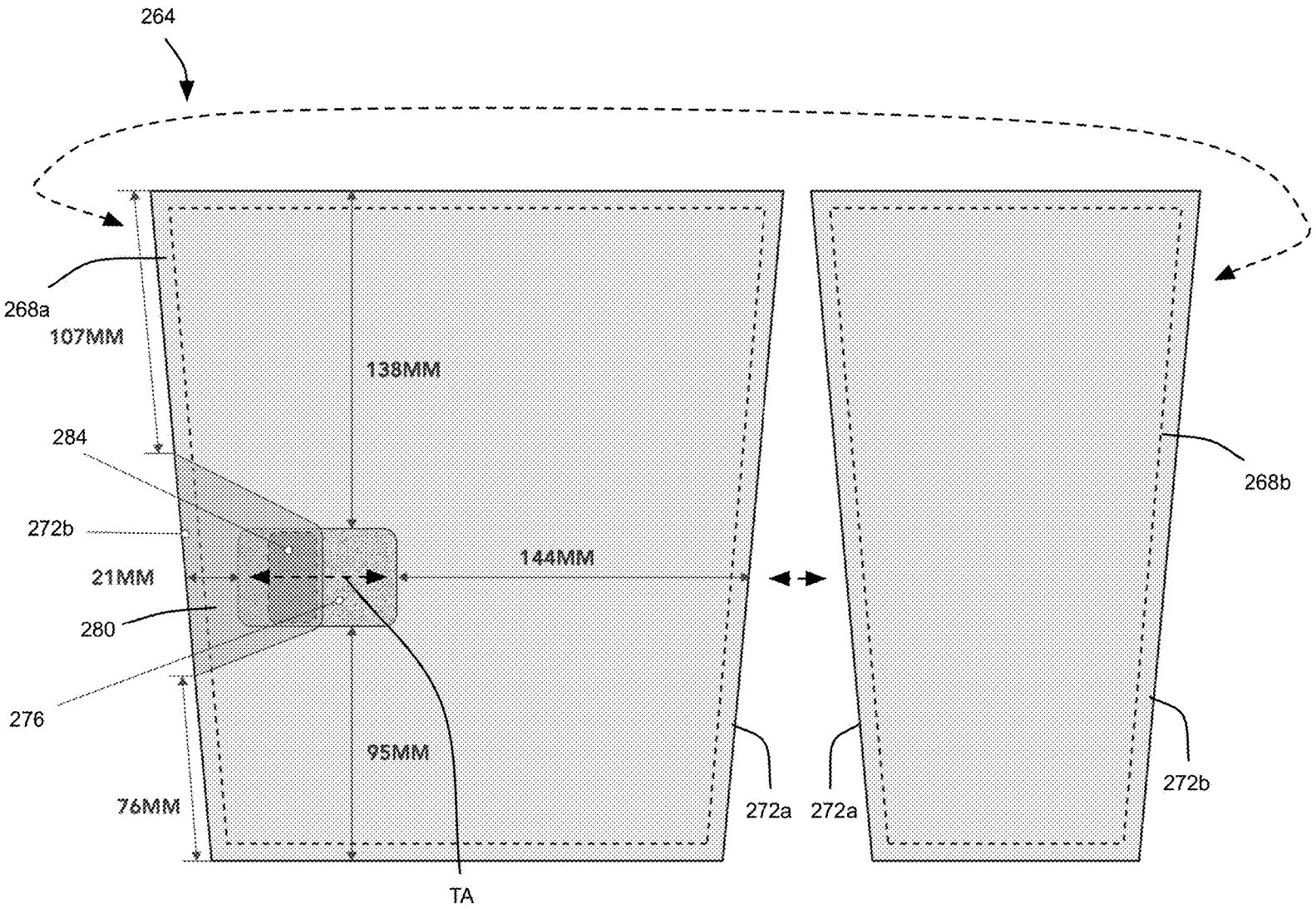
FIG. 9A shows two components of a knee support member of the pants of FIGS. 8A and 8B.
Figure 9B:
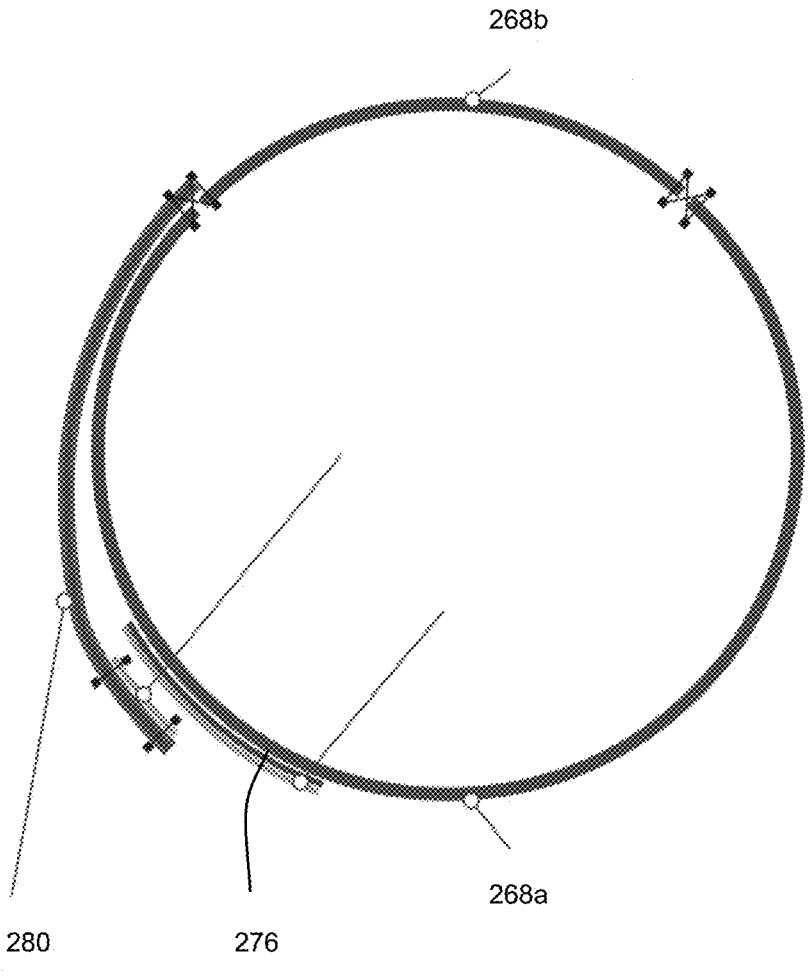
FIG. 9B is a top section view of the knee support member of FIG. 9A after assembly.

FIGS. 9A and 9B shows a knee support member 264 that is also integrated with the pants of FIGS. 8A and 8B as will be explained below. The knee support member 264 is formed from two panels 268*a*, 268*b* that are stitched together along a first set of opposing lateral edges 272*a* and along a second set of opposing lateral edges 272*b* to form a sleeve. The panels 268*a*, 268*b* are constructed from two layers of a compression fabric, such as lycra, with stretch TPU film by heat press. A loop fabric patch 276 is stitched on the panel 268*a*. A tab 280 having a microhook patch 284 secured on an undersurface thereof is stitched together with the lateral edges 272*b* of the panels 268*a*, 268*b*. By decoupling the microhook patch 284 from the loop fabric patch 276 and moving it along a tightening axis TA before resecuring it to the loop fabric patch 276, the knee support member 264 can be tightened or loosened about the knee of a wearer. The loop fabric patch 276 extends laterally so that the microhook patch 284 can be secured thereto along a range of lateral positions along the tightening axis TA.

Figure 9D:
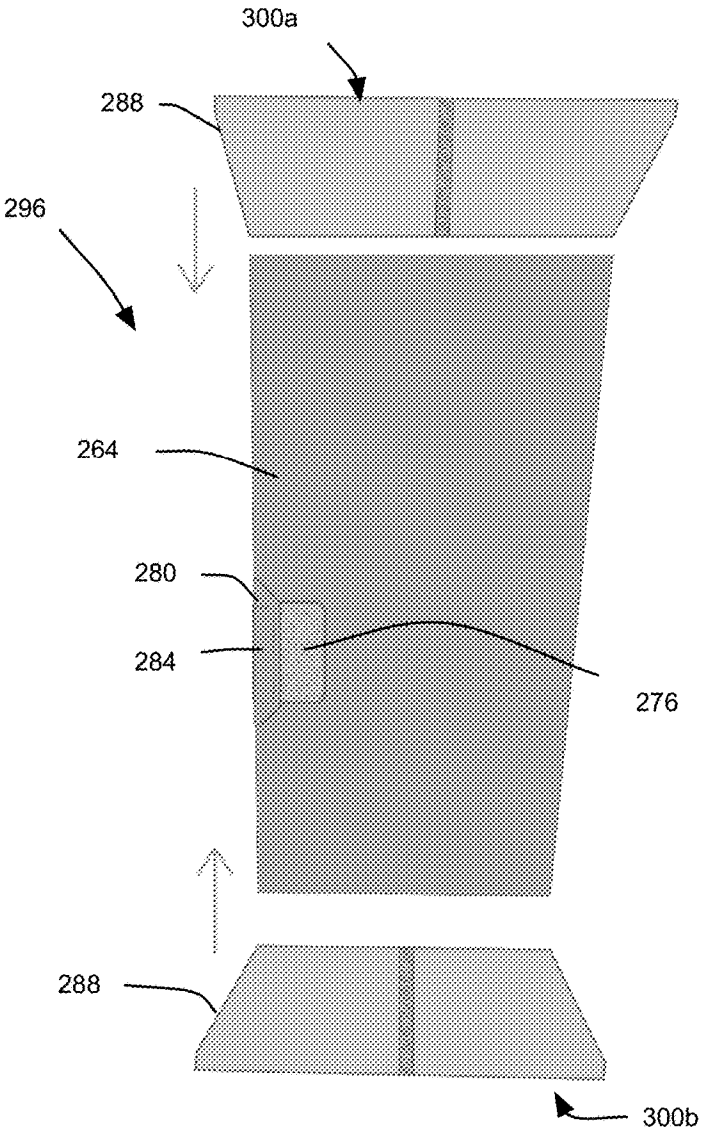
FIG. 9D shows a knee support structure assembled from the knee support member of FIG. 9A and two tether portions of FIG. 9C.
Figure 9C:
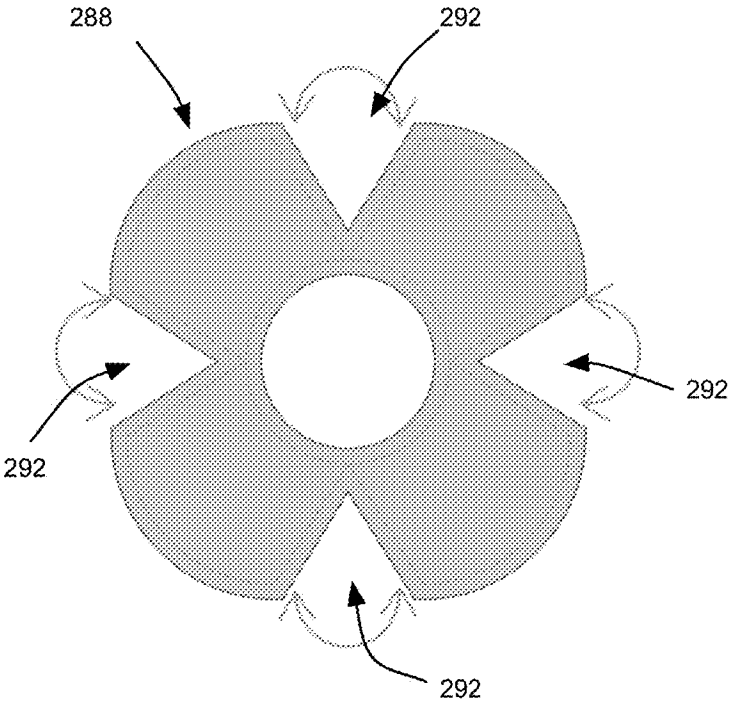
FIG. 9C shows one of two tether portions for connecting to the knee support member of FIG. 9A.

FIG. 9C shows a tether portion 288 that is stitched together to close gaps 292 in its shape to form a frustoconical gusset. One such tether portion 288 is stitched to top and bottom edges of the knee support member 264 to form a knee support structure 296, as shown in FIG. 9D. Connection regions 300*a*, 300*b* along the top and bottom tether portions 288, respectively, are positioned away from the knee support member 264.

Figure 10:
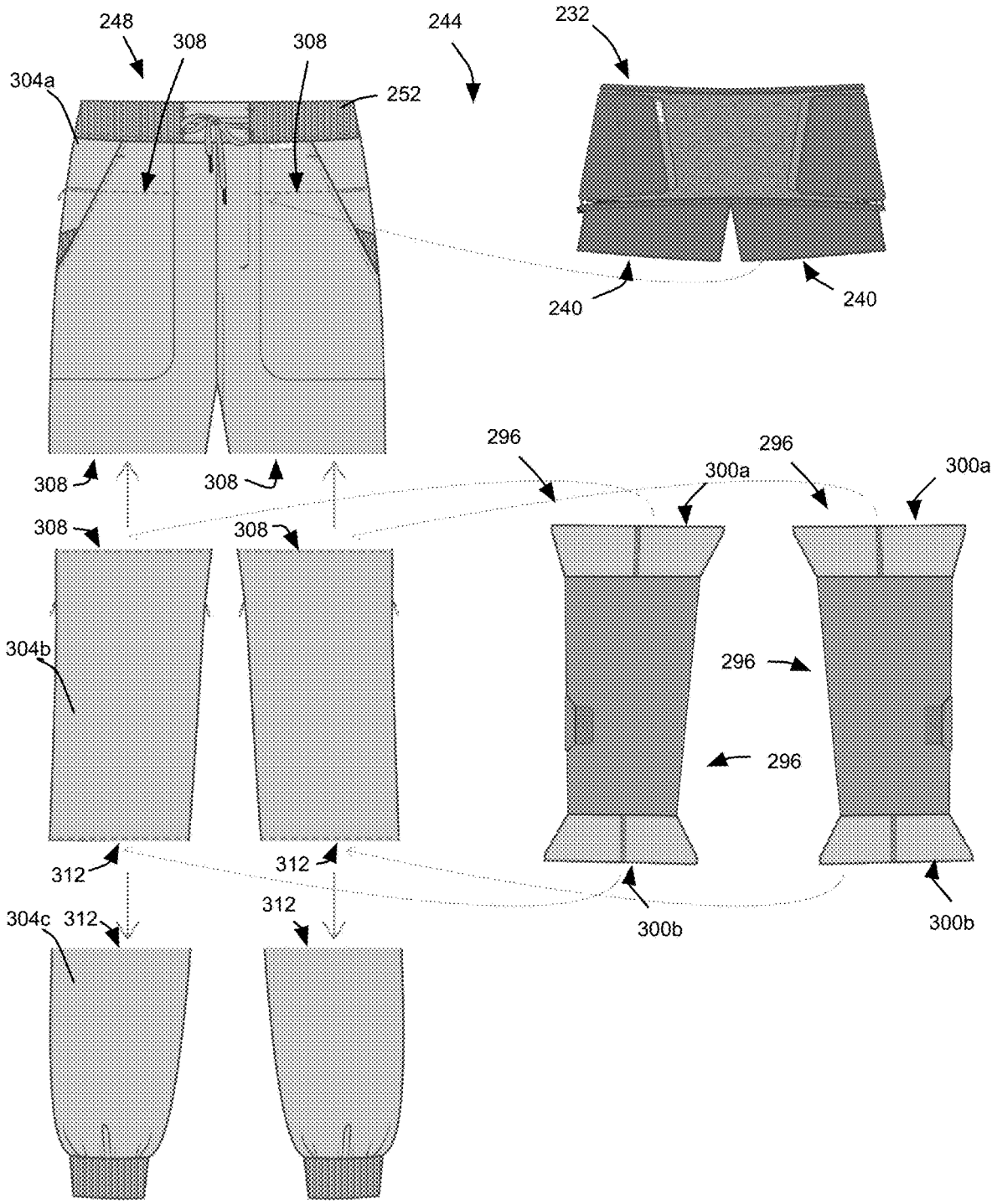
FIG. 10 shows the lumbar support structure of FIGS. 7E and 7F and the knee support structure of FIG. 9D being assembled with an outer shell to form the pants of FIGS. 8A and 8B.

FIG. 10 shows the full assembly of the pants 244 of FIGS. 8A and 8B. The outer shell 248 is formed from three outer shell components 304*a*, 304*b*, and 304*c*. The upper and middle outer shell components 304*a*, 304*b* have a first set of opposing edges 308, and the middle and lower outer shell components 304*b*, 304*c* have a second set of opposing edges 312. During assembly, the connection regions 240 of the lumbar support structure 232 are stitched to corresponding connection regions 308 of the top outer shell component 304*a* below and spaced from the waistline 252, as described above. The upper connection regions 300*a* of the two knee support structures 296 are stitched together with the connection regions 308 between the top and middle outer shell components 304*a*, 304*b*. The lower connection regions 300*b* of the two knee support structures are stitched together with the connection regions 312 between the middle and lower outer shell components 304*b*, 304*c*.

Figure 11A:
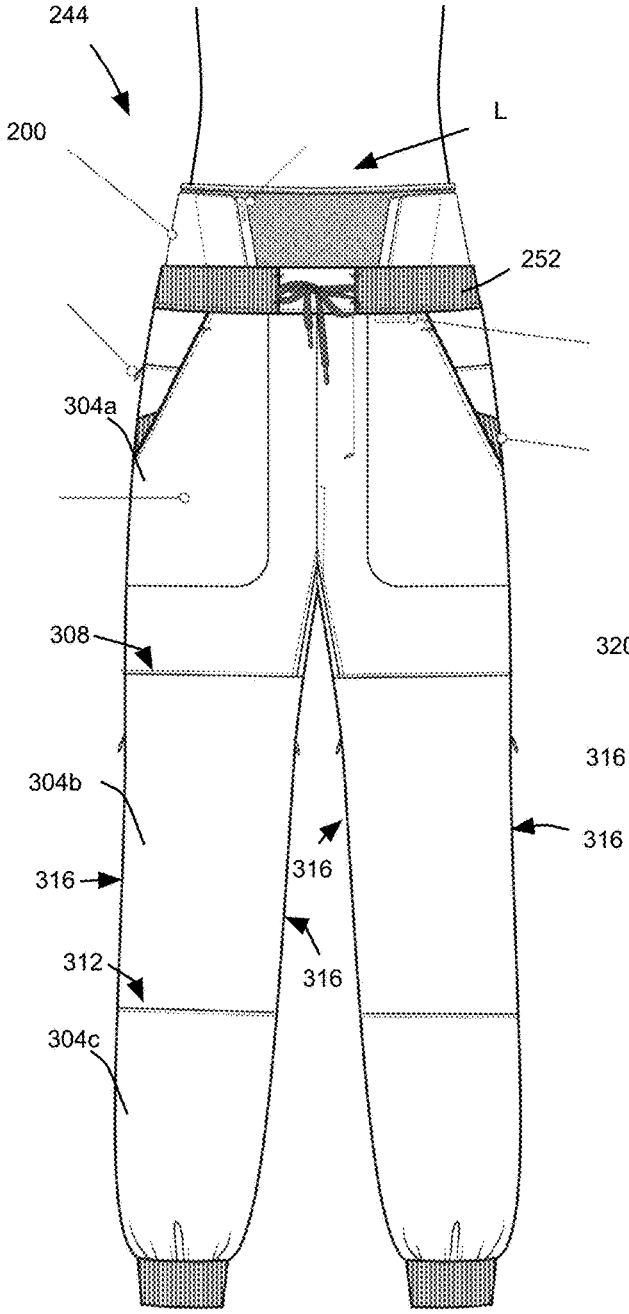
FIGS. 11A and 11B are front and rear views, respectively, of the assembled pants of FIG. 10.
Figure 11B:
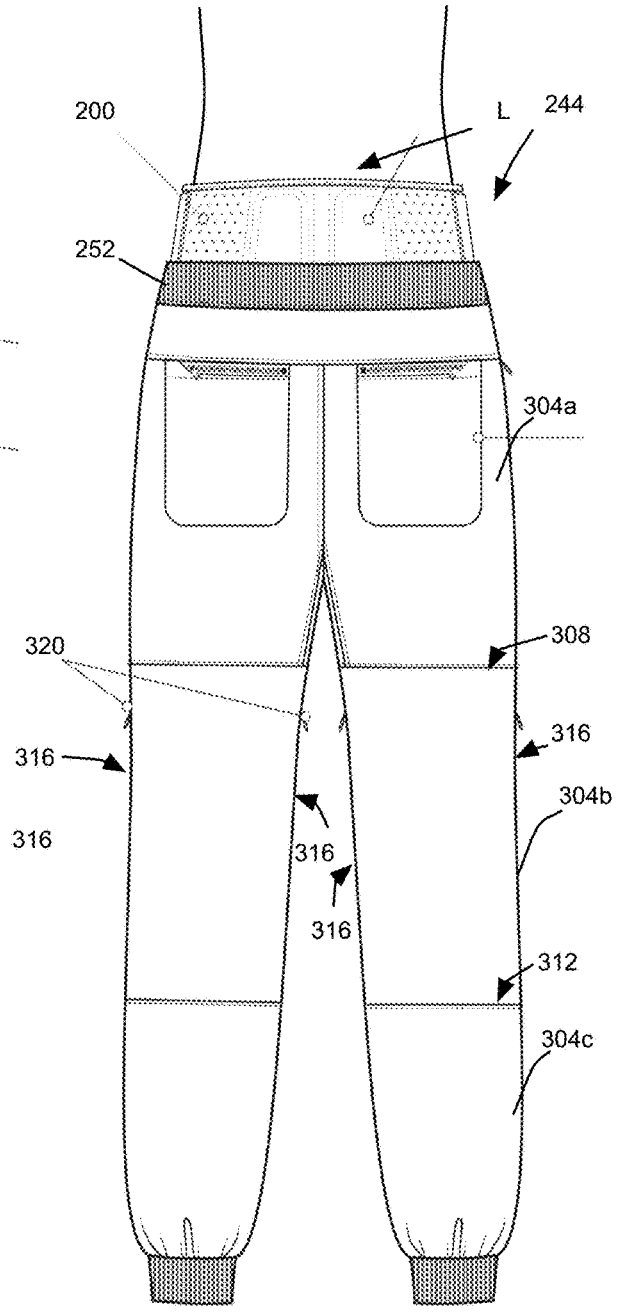

The assembled pants 244 are shown in FIGS. 11A and 11B. The outer shell 248 includes two adjustment openings 316 along opposite sides of each leg to provide access to the knee support member 264 to enable its adjustment, as described above. Zippers 320 reopenably close the adjustment openings 316, but buttons, hook-and-loop fabric strips, or any other suitable closure elements can be employed to reopenably close the adjustment openings.

Figure 12:
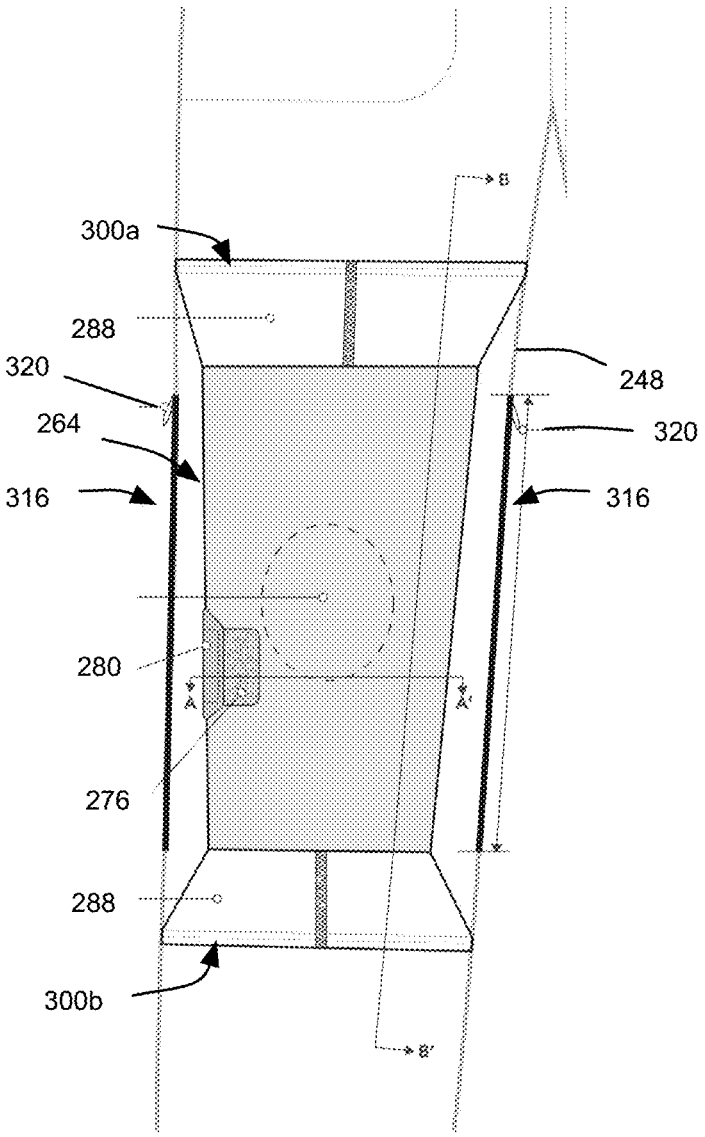
FIG. 12 is a schematic diagram illustrating the configuration of the knee support structure and the outer shell.

FIG. 12 shows the relationship between the knee support member 264 and the outer shell 248 of the pants 244. The knee support member 264 is dimensioned to fit snugly about the mid-leg of a wearer about the knee, in contrast to the outer shell 248 that fits relatively loosely about the leg of the wearer. The knee support member 264 is stitched to the tether portions 288 that are, in turn, stitched via the connection regions 300*a*, 300*b* to the outer shell 248. While the knee support member 264 fits snugly about the mid-leg of the wearer, the outer shell 248 is afforded freedom to move loosely as the tether portions 288 provide sufficient slack between the knee support member 264 and the outer shell 248. The adjustment openings 316 enable the user to adjust the support provided by the knee support member 264 while the pants 244 are being worn by the user.

Figure 13A:
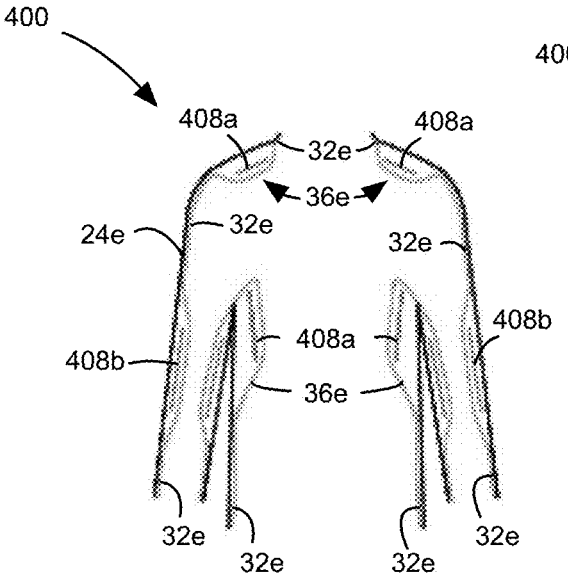
FIGS. 13A and 13B show section and schematic views, respectively, of a top in accordance with still another embodiment, wherein floating support members are positioned over internal webbing.
Figure 13B:
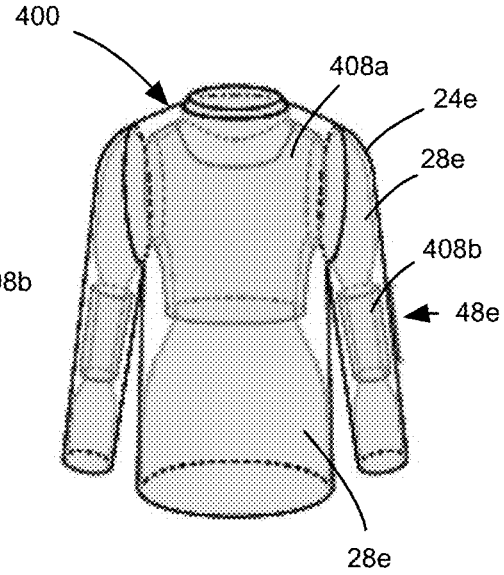

FIGS. 13A and 13B shows a top 400 in accordance with another embodiment. The top 400 has a support structure 28*e* that extends internally over an entire outer shell 24*e* and is connected to the outer shell 24*e* at connection regions 32*e*. Floating support members 408*a* and 408*b* are positioned between the outer shell 24*e* and floating regions 36*e* of the support structure 28*e*. The floating support members 408*a*, 408*b* provide support zones that may be shifted relative to the floating regions 36*e* and the outer shell 24*e*, as the floating support members 408*a*, 408*b* are not secured to the support structure 28*e*.

Recloseable openings 48*e* are provided in the outer shell 24*e* to enable adjustment of the positioning of the floating support members 408*b* providing the support members on the elbow regions of the wearer. Each recloseable opening 48*e* can take the form of a zippered slit, an opening with overlapping panels that are unsecured or held together via one or more buttons or snaps, or hook-and-loop connectors, etc.

Figure 13C:
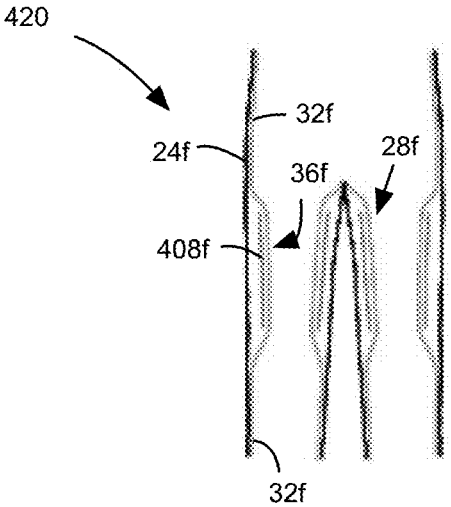
FIGS. 13C and 13D show section and schematic views, respectively, of pants in accordance with a further embodiment, wherein floating support members are positioned over internal webbing.
Figure 13D:
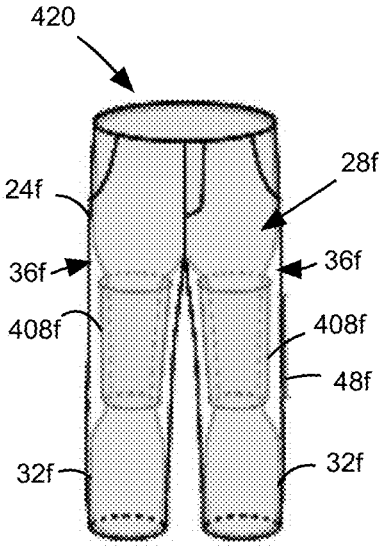

FIGS. 13C and 13D shows a pair of pants 420 having an outer shell 24*f* through which a support structure 28*f* extends internally. The support structure 28*f* is connected to the outer shell 24*f* at connection regions 32*f*. Floating support members 408*f* are positioned between the outer shell 24*f* and floating regions 36*f* of the support structure 28*f*. The floating support members 408*f* provide support zones that may be shifted relative to the floating regions 36*f* and the outer shell 24*f*, as the floating support members 408*f* are not secured to the support structure 28*f*.

Recloseable openings 48*f* are provided in the outer shell 24*f* to enable adjustment of the positioning of the floating support members 408*f* providing the support zones on the knee regions of the wearer. Each recloseable opening 48*f* can take the form of a zippered slit, an opening with overlapping panels that are unsecured or held together via one or more buttons or snaps, or hook-and-loop connectors, etc.

In the configurations of FIGS. 13A to 13D, it is possible to change the support provided by the floating support members 408*a*, 408*b*. The floating support members 408*a*, 408*b* can be made to be removeable via a zipper or other fastener so that they can be removed and replaced via the recloseable openings 48*f*, thereby enabling articles of clothing to readily adjusted for the support needs of the wearer.

Figure 14A:
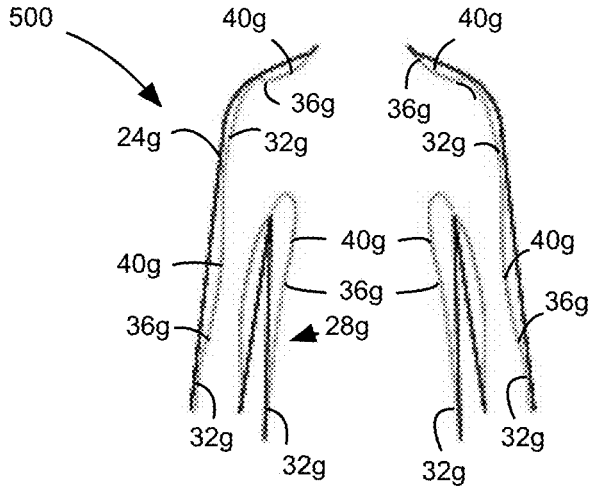
FIGS. 14A and 14B show section and schematic views, respectively, of a top in accordance with another embodiment, wherein a support member is defined by a different material woven, bonded, or stitched to a portion of the floating region.
Figure 14B:
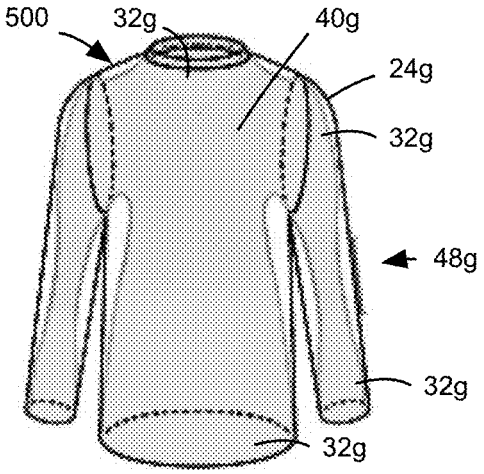

FIGS. 14A and 14B show a top 500 in accordance with a further embodiment. The top 500 has a support structure 28*g* that extends internally over an entire outer shell 24*g* and is connected to the outer shell 24*g* at connection regions 32*g*. Support members 40*g* are provided by different weaves or materials woven or assembled into floating regions 36*g* and can be designed to provide targeted support to particular areas of the body of the wearer. Suitable materials for the floating regions 36*g* can include, for example, a seamless knit where the floating regions 36*g* are made using different weaves. If the support members 40*g* are made by an assembly of materials that are stitched or bonded, it could be, for example, jersey, interlock, mesh, Ponte de Roma (double knit fabric), rib, canvas/plain weave, twill/serge, poplin, etc.

Recloseable openings 48*g* is provided in the outer shell 24*g* to enable adjustment of the positioning of the support members 40*g* on the elbow regions of the wearer. Each recloseable opening 48*g* can take the form of a zippered slit, an opening with overlapping panels that are unsecured or held together via one or more buttons or snaps, or hook-and-loop connectors, etc. Recloseable openings can optionally be provided on the torso to enable adjustment of the support member 40*g* positioned thereon.

Figure 14C:
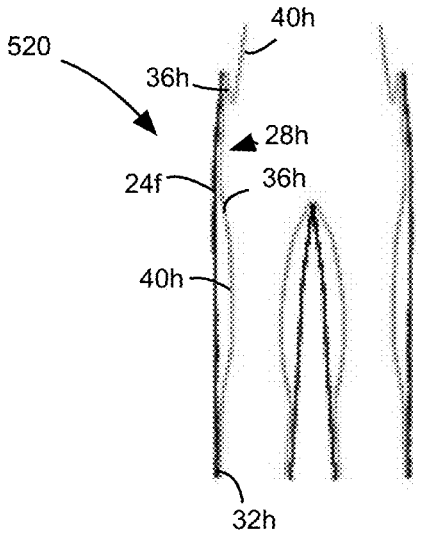
FIGS. 14C and 14D show section and schematic views, respectively, of pants in accordance with yet another embodiment, wherein a support member is defined by a different material woven, bonded, or stitched to a portion of the floating region.
Figure 14D:
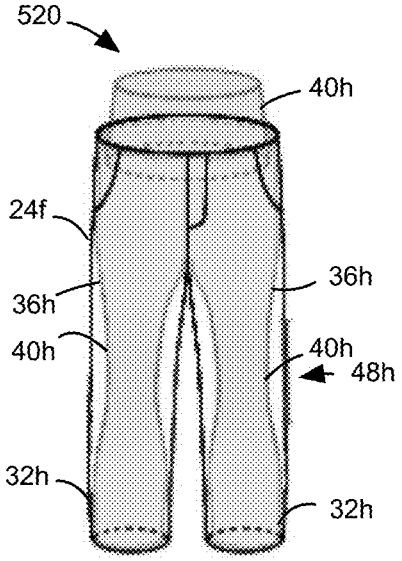

FIGS. 14C and 14D shows a pair of pants 520 having an outer shell 24*h* through which a support structure 28*h* extends internally. The support structure 28*h* is connected to the outer shell 24*h* at connection regions 32*h*. Support members 40*h* are provided by different weaves or materials woven into floating regions 36*h* and can be designed to provide targeted support to particular areas of the body of the wearer.

Recloseable openings 48*h* are provided in the outer shell 24*h* to enable adjustment of the positioning of the floating support members 508*h* providing the support members on the knee regions of the wearer. Each recloseable opening 48*h* can take the form of a zippered slit, an opening with overlapping panels that are unsecured or held together via one or more buttons or snaps, or hook-and-loop connectors, etc.

Figure 15A:
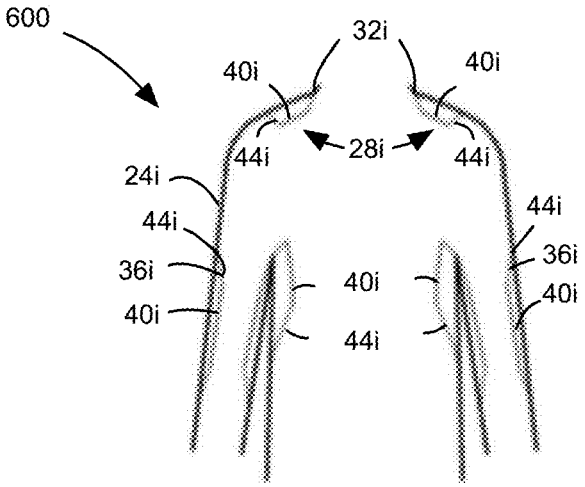
FIGS. 15A and 15B show section and schematic views, respectively, of a top in accordance with a further embodiment, wherein support members are tethered to the outer shell via straps.
Figure 15B:
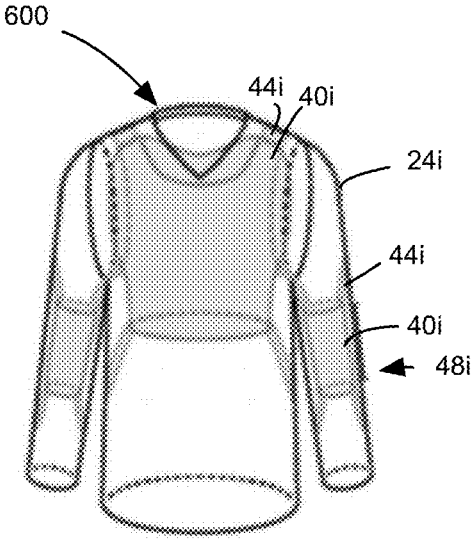

FIGS. 15A and 15B show a top 600 in accordance with a yet another embodiment. A set of support structures 28*i* are connected to an outer shell 24*i* at connection regions 32*i*. Support members 40*i* providing support zones are retained by tether portions 44*i* that include straps, textile panels, etc.

Recloseable openings 48*i* are provided in the outer shell 24*i* to enable adjustment of the positioning of the support members 40*i* on the elbow regions of the wearer. Each recloseable opening 48*i* can take the form of a zippered slit, an opening with overlapping panels that are unsecured or held together via one or more buttons or snaps, or hook-and-loop connectors, etc.

Figure 15C:
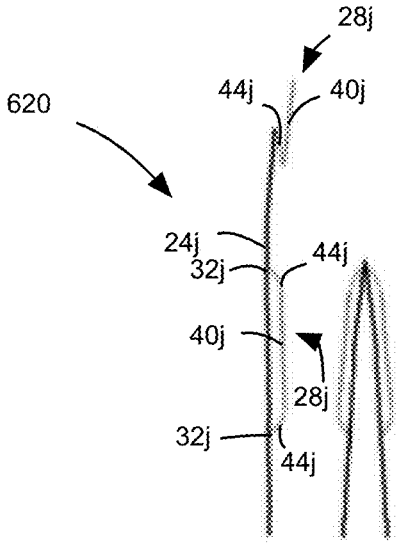
FIGS. 15C and 15D show section and schematic views, respectively, of pants in accordance with still another embodiment, wherein support members are tethered to the outer shell via straps.
Figure 15D:
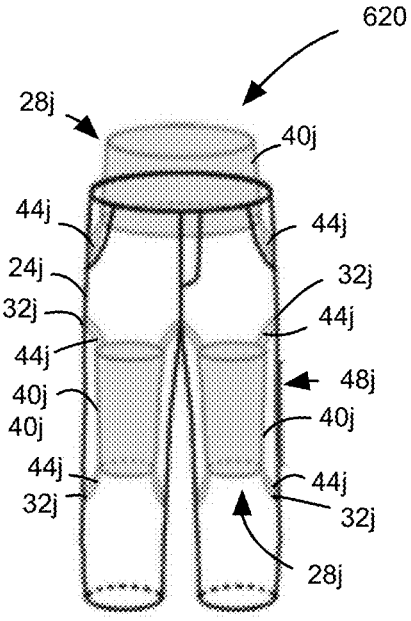

FIGS. 15C and 15D show a pair of pants 620 having an outer shell 24*j*. A set of support structures 28*j* is connected to the outer shell 24*j* at connection regions 32*j*. The support structures 28*j* include support members 40*j* providing support zones that are retained by tether portions 44*j* that include straps, textile panels, etc. The straps, textile panels, etc. are connected at distal ends thereof to the outer shell 24*j*.

Recloseable openings 48*j* are provided in the outer shell 24*j* to enable adjustment of the positioning of the floating support members 40*j* providing the support zones on the knee regions of the wearer. Each recloseable opening 48*j* can take the form of a zippered slit, an opening with overlapping panels that are unsecured or held together via one or more buttons or snaps, or hook-and-loop connectors, etc.

The support members can be made of any suitable material or material structures. Exemplary materials for providing the support members can include, for example, stretch knit fabric with thermoplastic polyurethane (TPU) bonding, perforated stretch knit fabric with TPU bonding, stretch knit fabric with silicone details, stretch knit fabric with TPU bonding mixed with stretch mesh for more breathability, heavy stretch knit fabric (optionally with silicone details), seamless knitted sleeves, neoprene, TPU or polyurethane (PU), and stretch woven fabric.

The tether portions can be made of any suitable material or material structures for connecting areas of the support members to the outer shell. Examples include a stretch poly spandex mesh or a lightweight Lycra.

The support members and the tether portions can be formed unitarily. For example, the support members and the tether portions can be woven as one piece with different knits being employed in the support member to provide different characteristics. In another example, additional materials can be applied or stitched to the woven pieces to form the support members.

The support structures can be connected to the outer shell in the connection regions via any suitable means, such as stitching, bonding, etc.

The outer shells can be made of any suitable material for apparel.

The articles of clothing herein provide support for the postural (thoracic), lower back (lumbar and core), neck (cervical) and head, elbow, knee, ankle and feet, hips, vascular, and muscular requirements of the wearer.

In other embodiments, it is desirable to enable relatively independent positioning of the outer shell and the support member on the body of a wearer.

While the invention has been illustrated and described with respect to tops and pants, the same concepts can be applied to other types of clothing items, such as shorts, t-shirts, shirts, vests, jackets, one-piece suits, bras, underwear (panties, briefs, boxers, etc.), base layers, etc.

Although specific advantages have been enumerated above, various embodiments may include some, none, or all of the enumerated advantages.

Persons skilled in the art will appreciate that there are yet more alternative implementations and modifications possible, and that the above examples are only illustrations of one or more implementations. The scope, therefore, is only to be limited by the claims appended hereto and any amendments made thereto.

What is claimed is:

1. A clothing article having a support member, comprising:

an outer shell, a portion of the outer shell being dimensioned to fit loosely on a body of a wearer; and a support structure having a support member supporting the body of the wearer when positioned thereon, the support member fitting snugly on the body of the wearer, a first tether portion extending between the support member towards a first longitudinal end thereof that is configured to receive the wearer and a first connection region that is secured to an inside surface of the outer shell that is positioned adjacent to the wearer when the clothing article is worn, and a second tether portion extending between the support member towards a second longitudinal end thereof opposite the first longitudinal end and a second connection region that is secured to the inside surface of the outer shell that is positioned adjacent to the wearer when the clothing article is worn, at least a part of the first tether portion and the second tether portion being dimensioned to enable the outer shell to move substantially freely relative to the support member when the clothing article is worn by the wearer.

2. The clothing article of claim 1, wherein the outer shell has at least one opening to enable the wearer to adjust a position of or the compression provided by the support member.

3. The clothing article of claim 1, wherein the support member includes at least one stiffening member to resist flexion of the support member.

4. The clothing article of claim 1, wherein the support member has a tension adjustment structure for adjusting tension of the support member on the body of the wearer.

5. The clothing article of claim 1, wherein the clothing article is a top, and wherein the support member is configured to support the posture of the wearer.

6. The clothing article of claim 1, wherein the clothing article is pants, and wherein the support member is a knee support member supporting a knee of the wearer when the pants are worn by the wearer.

7. The clothing article of claim 6, wherein a leg of the outer shell within which the knee support member is positioned has at least one opening facilitating adjustment of a position or tension of the knee support member when the pants are worn.

8. The clothing article of claim 1, wherein the first tether portion and the second tether portion are provided by a sleeve, wherein the first connection region is at a first end of the sleeve, wherein the second connection region is at a second end of the sleeve, and wherein the support member is slidably repositionable along a longitudinal length of the sleeve.

9. A clothing article having a support member, comprising:

an outer shell; and a support structure having a first longitudinal end configured to receive a wearer, the first longitudinal end being connected to the outer shell along a first connection region, the support structure having a second longitudinal end opposite the first longitudinal end and connected to the outer shell along a second connection region, each of the first connection region and the second connection region being secured to an inside surface of the outer shell that is positioned adjacent to a wearer when the clothing article is worn and having a floating region extending between the first connection region and the second connection region, the floating region having a support member supporting the body of the wearer when positioned thereon, the floating region having a first tether portion extending between the support member and the first connection region, the floating region having a second tether portion extending between the support member and the second connection region, at least a part of the first tether portion and the second tether portion being dimensioned to enable the outer shell to move substantially freely relative to the support member.

10. The clothing article of claim 9, wherein the outer shell is dimensioned to fit loosely on the body of a wearer.

11. The clothing article of claim 9, wherein the support member is dimensioned to fit snugly on the body of a wearer.

12. The clothing article of claim 9, wherein the outer shell has at least one opening to enable the wearer to adjust a position or the compression provided by the support member.

13. The clothing article of claim 9, wherein the support member includes at least one stiffening member to resist flexion of the support member.

14. The clothing article of claim 9, wherein the support member has a tension adjustment structure for adjusting tension of the support member on the body of the wearer.

15. The clothing article of claim 9, wherein the clothing article is a top, and wherein the support member is configured to support the posture of the wearer.

16. The clothing article of claim 9, wherein the clothing article is pants, and wherein the support member is a knee support member supporting a knee of the wearer when the pants are worn by the wearer.

17. The clothing article of claim 16, wherein a leg of the outer shell within which the knee support member is positioned has at least one opening facilitating adjustment of a position or tension of the knee support member when the pants are worn.

18. The clothing article of claim 9, wherein the at least one tether portion is provided by a sleeve, wherein the first connection region is at a first end of the sleeve, wherein the second connection region is at a second end of the sleeve, and wherein the support member is slidably repositionable along a longitudinal length of the sleeve.

* * * * *